US007984896B2

(12) United States Patent
Kawaguchi

(10) Patent No.: US 7,984,896 B2
(45) Date of Patent: Jul. 26, 2011

(54) SHEET FOLDING APPARATUS AND IMAGE FORMING APPARATUS USING THE SAME

(75) Inventor: Takahiro Kawaguchi, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/027,228

(22) Filed: Feb. 14, 2011

(65) Prior Publication Data

US 2011/0136644 A1 Jun. 9, 2011

Related U.S. Application Data

(62) Division of application No. 12/392,716, filed on Feb. 25, 2009, now Pat. No. 7,909,316.

(60) Provisional application No. 61/032,041, filed on Feb. 27, 2008, provisional application No. 61/042,668, filed on Apr. 4, 2008.

(51) Int. Cl.
*B65H 37/06* (2006.01)

(52) U.S. Cl. ..... 270/32; 270/45; 493/444; 493/445

(58) Field of Classification Search ..... 270/32, 270/45; 493/444, 445
See application file for complete search history.

(56) References Cited

U.S. PATENT DOCUMENTS

| | | | | |
|---|---|---|---|---|
| 3,926,425 | A * | 12/1975 | Pierce et al. | 493/444 |
| 4,905,977 | A * | 3/1990 | Vijuk | 270/45 |
| 5,169,376 | A * | 12/1992 | Ries et al. | 493/445 |
| 5,374,233 | A * | 12/1994 | Lehmann et al. | 493/421 |
| 5,445,592 | A * | 8/1995 | Richards | 493/444 |
| 6,755,410 | B2 * | 6/2004 | Kaneko | 270/32 |
| 7,537,558 | B2 * | 5/2009 | Vono et al. | 493/443 |
| 2004/0058793 | A1 | 3/2004 | Blanchard et al. | |
| 2005/0277537 | A1 | 12/2005 | Matsushita | |
| 2006/0055100 | A1 | 3/2006 | Suzuki et al. | |
| 2007/0270297 | A1 | 11/2007 | Blanchard et al. | |
| 2008/0308984 | A1 | 12/2008 | Dobashi et al. | |
| 2009/0258774 | A1 | 10/2009 | Suzuki et al. | |

FOREIGN PATENT DOCUMENTS

| | | |
|---|---|---|
| JP | 2002-012364 | 1/2002 |
| JP | 2005-187126 | 7/2005 |

* cited by examiner

*Primary Examiner* — Patrick Mackey
(74) *Attorney, Agent, or Firm* — Patterson & Sheridan, LLP

(57) ABSTRACT

A sheet folding apparatus includes: a fold roller pair which forms a nipping portion and inserts the center of a sheet bundle into the nipping portion to form a fold in the sheet bundle; a folding blade which moves from a standby position and presses the center of the sheet bundle against the nipping portion when the fold is formed, and returns to the standby position after the pressing of the nipping portion is completed; and a protection member which prevents an access to a front edge of the folding blade in a longitudinal direction of the front edge when the folding blade is located at the standby position.

10 Claims, 25 Drawing Sheets

BEFORE PARALLELISM ADJUSTMENT

AFTER PARALLELISM ADJUSTMENT

DIAGRAM OF ADJUSTMENT PIN AS VIEWED FROM REAR SIDE

ASSEMBLY DIAGRAM

BEFORE PARALLELISM ADJUSTMENT

AFTER PARALLELISM ADJUSTMENT

BEFORE PARALLELISM ADJUSTMENT

AFTER PARALLELISM ADJUSTMENT

STANDBY POSITION
(HOME POSITION)

FOLDING POSITION

SHEET FOLDING APPARATUS AND IMAGE FORMING APPARATUS USING THE SAME

CROSS-REFERENCE TO RELATED APPLICATIONS

This application is a divisional of U.S. patent application Ser. No. 12/392,716, filed Feb. 25, 2009, which is based upon and claims the benefit of priority from: U.S. provisional applications 61/032,041 filed on Feb. 27, 2008 and 61/042,668 filed on Apr. 4, 2008, the entire contents of each of which are incorporated herein by reference.

TECHNICAL FIELD

Described herein relates to a sheet folding apparatus and an image forming apparatus using the sheet folding apparatus, and more particularly, to a sheet folding apparatus stitching and folding printed sheets and an image forming apparatus using the sheet folding apparatus.

BACKGROUND

Hitherto, a sheet finisher is known which is disposed downstream of an image forming apparatus such as a copier, a printer, or a multi-functional peripheral (MFP) and performs finishing such as punching or stitching on printed sheets.

Recently, functions of a sheet finisher are diversified, and a sheet finisher (sheet folding apparatus) is developed which has, in addition to the punching and stitching functions, a folding function of folding a part of a sheet, or a saddle-stitching and folding function of stitching the center of a sheet with staples and then folding the sheet at the center (see JP-A 2004-106991, U.S. Pat. No. 6,905,118, etc.).

A sheet folding apparatus having the saddle-stitching and folding function can form a booklet (bind a book) from plural printed sheets.

In the saddle-stitching and folding hitherto developed, the center of sheets is stitched with staples or the like and then the stitched portion is creased and folded by a pair of rollers called fold rollers. In this process, a plate-like member called a folding blade is applied to the stitched portion of the sheet bundle and is pushed into a nipping portion of the fold roller pair to crease the sheet bundle.

To form an excellent fold, the folding blade is usually formed of a very thin metal plate and thus the folding blade has a sharp edge.

In the meantime, a paper jam may occur in the nipping portion of the fold roller pair or in the vicinity thereof due to some reasons in the course of performing the folding function.

When the paper jam occurs, the movement of the fold roller pair and the folding blade is automatically stopped. Thereafter, a user accesses a position where the paper jam occurs and removes the sheet bundle. The method of removing sheets depends on the position of the paper jam or the status of the paper jam.

When the paper jam occurs such that the sheet bundle is exposed to the outside of the fold roller pair, for example, the fold roller pair is manually rotated to forcibly push out the jammed sheet bundle to the outside (in the conveyance direction) of the fold roller pair. Alternatively, the fold roller pair pressed to each other is manually separated temporarily and the sheet bundle nipped in the nipping portion of the fold roller pair is pulled out to the outside (in the conveyance direction) of the fold roller pair.

In contrast, when the sheet bundle is not exposed to the outside of the fold roller pair and the sheet bundle can not be pushed out to the outside of the fold roller pair even with the manual rotation of the fold roller pair, the user must access the inside (the opposite direction of the conveyance direction) of the fold roller pair and remove the sheet bundle.

The folding blade is placed inside the fold rollers and the edge of the folding blade is sharp as described above. Accordingly, when the user's finger, etc. carelessly approaches the nipping portion or the vicinity thereof in the fold roller pair, the user's finger, etc. may be injured with the edge of the folding blade.

SUMMARY

Described herein relates to a sheet folding apparatus including: a fold roller pair which forms a nipping portion and inserts the center of a sheet bundle into the nipping portion to form a fold in the sheet bundle; a folding blade which moves from a standby position and presses the center of the sheet bundle against the nipping portion when the fold is formed, and returns to the standby position after the pressing of the nipping portion is completed; and a protection member which prevents an access to a front edge of the folding blade in a longitudinal direction of the front edge when the folding blade is located at the standby position.

Described herein relates to an image forming apparatus including: a scanner section which optically reads an original document and generates image data; an image forming section which prints the image data on sheets; and a sheet folding apparatus which folds the center of a sheet bundle of the printed sheets and forms a booklet. Here, the sheet folding apparatus includes: a fold roller pair which forms a nipping portion and inserts the center of the sheet bundle into the nipping portion to form a fold in the sheet bundle; a folding blade which moves from a standby position and presses the center of the sheet bundle against the nipping portion when the fold is formed, and returns to the standby position after the pressing of the nipping portion is completed; and a protection member which prevents an access to a front edge of the folding blade in a longitudinal direction of the front edge when the folding blade is located at the standby position.

DESCRIPTION OF THE DRAWINGS

In the accompanying drawings,

FIGS. 23A and 238 are side views schematically illustrating a positional relation between the protection member and the folding blade;

DETAILED DESCRIPTION

A sheet folding apparatus and an image forming apparatus according to embodiments will be described with reference to the accompanying drawings.

(1) Configuration of Image Forming Apparatus and Sheet Folding Apparatus

Figure 1:
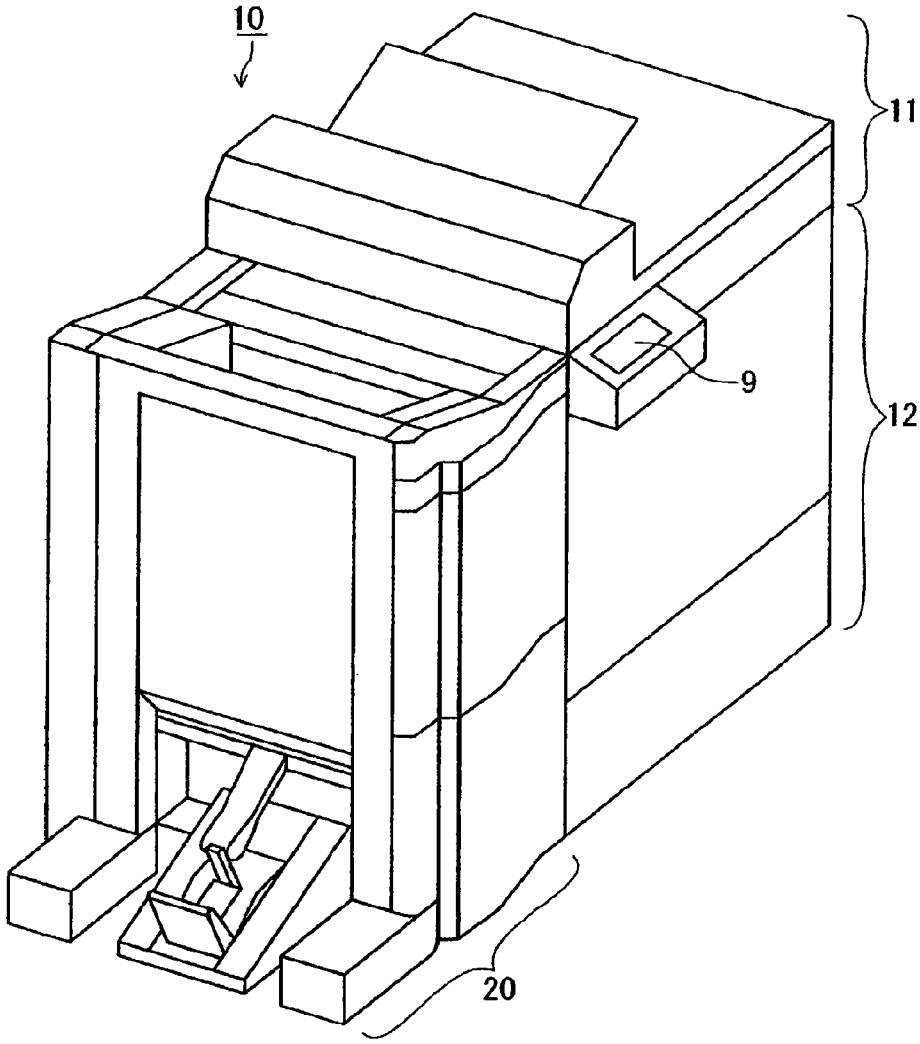
FIG. 1 is a perspective view illustrating an appearance of an image forming apparatus according to an embodiment.

FIG. 1 is an appearance perspective view illustrating a basic configuration of an image forming apparatus 10 according to an embodiment. The image forming apparatus 10 includes a reading section 11 reading an original document, an image forming section 12 printing image data of the read original document on a sheet in an electrophotographic manner, and a sheet finisher 20 perform finishing such as sorting, punching, folding, or saddle-stitching on the printed sheet. The image forming section 12 includes an operation section 9 by which a user performs various operations.

Figure 2:
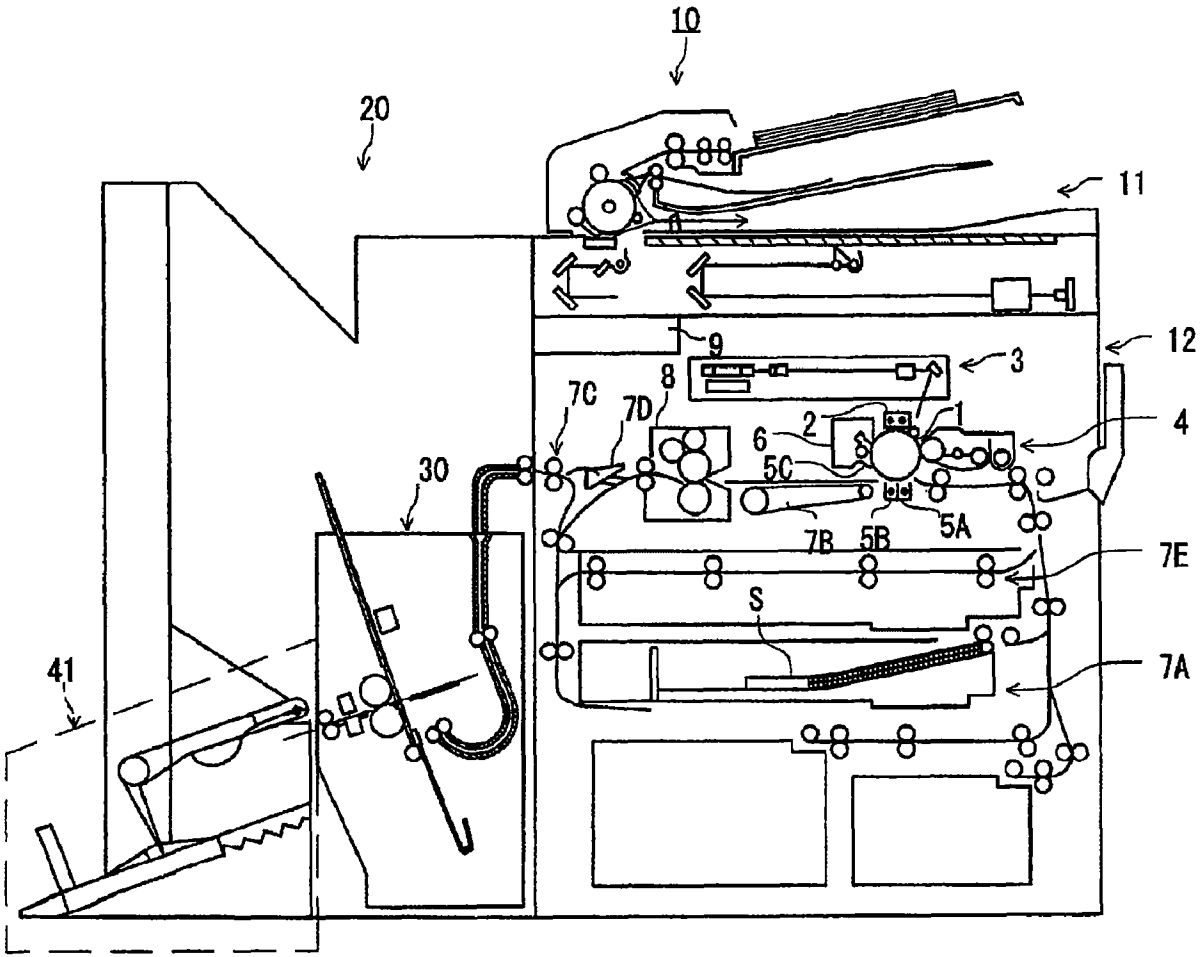
FIG. 2 is a sectional view illustrating a configuration of the image forming apparatus.

FIG. 2 is a sectional view illustrating a detailed configuration of the image forming apparatus 10.

The image forming section 12 of the image forming apparatus 10 includes a photoconductive drum 1 at the center. A charging unit 2, an exposure unit 3, a developing unit 4, a transfer unit 5A, a charge removing unit 5B, a separation pawl 5C, and a cleaning unit 6 are respectively disposed around the photoconductive drum 1. Besides, a fixing unit 8 is disposed downstream of the charge removing unit 5B. An image forming is performed by these units roughly in the following procedure.

First, the charging unit 2 uniformly charges the surface of the photoconductive drum 1. An original document read by the reading section 11 is converted into image data and is inputted to the exposure unit 3. The exposure unit 3 applies a laser beam corresponding to the level of the image data to the photoconductive drum 1 to form an electrostatic latent image on the photoconductive drum 1. The electrostatic latent image is developed with toner supplied from the developing unit 4 and a toner image is formed on the photoconductive drum 1.

Meanwhile, a sheet contained in a sheet containing unit 7A is conveyed to a transfer position (a gap between the photoconductive drum 1 and the transfer unit 5A) by some conveyance rollers. At the transfer position, the toner image is transferred from the photoconductive drum 1 to the sheet by the transfer unit 5A. Electric charges on the surface of the sheet to which the toner image is transferred are removed by the charge removing unit 5B. Then, the sheet goes away from the photoconductive drum 1 by the separation pawl 5C. Thereafter, the sheet is conveyed by an intermediate conveyance unit 7B and is heated and pressed by the fixing unit 8 so that the toner image is fixed to the sheet. The sheet subjected to the fixing is discharged from a discharge section 7C and is outputted to the sheet finisher 20.

The cleaning unit 6 located downstream of the separation pawl 5C removes the developer remaining on the surface of the photoconductive drum 1 and prepares for a next image formation.

When duplex printing is performed, a path of the sheet on the front side of which the toner image is formed is made to branch from a normal discharge path by a conveyance path switching plate 7D and the sheet is switched back by an inversion conveyance section 7E to invert the front and back sides. The same printing as a single-side printing is performed on the back side of the inverted sheet and the sheet is outputted to the sheet finisher 20 from the discharge section 7C.

The sheet finisher 20 includes a sheet folding apparatus 30 and a sheet bundle loading section 41 in addition to a sorter section sorting sheets.

The sheet folding apparatus 30 performs a process (saddle-stitching) of stitching the center of plural printed sheets discharged from the image forming section 12 with staples and then folding the sheets to form a booklet.

The booklet subjected to the saddle-stitching by the sheet folding apparatus 30 is outputted to the sheet bundle loading section 41 and the bound booklet is finally loaded thereon.

Figure 3:
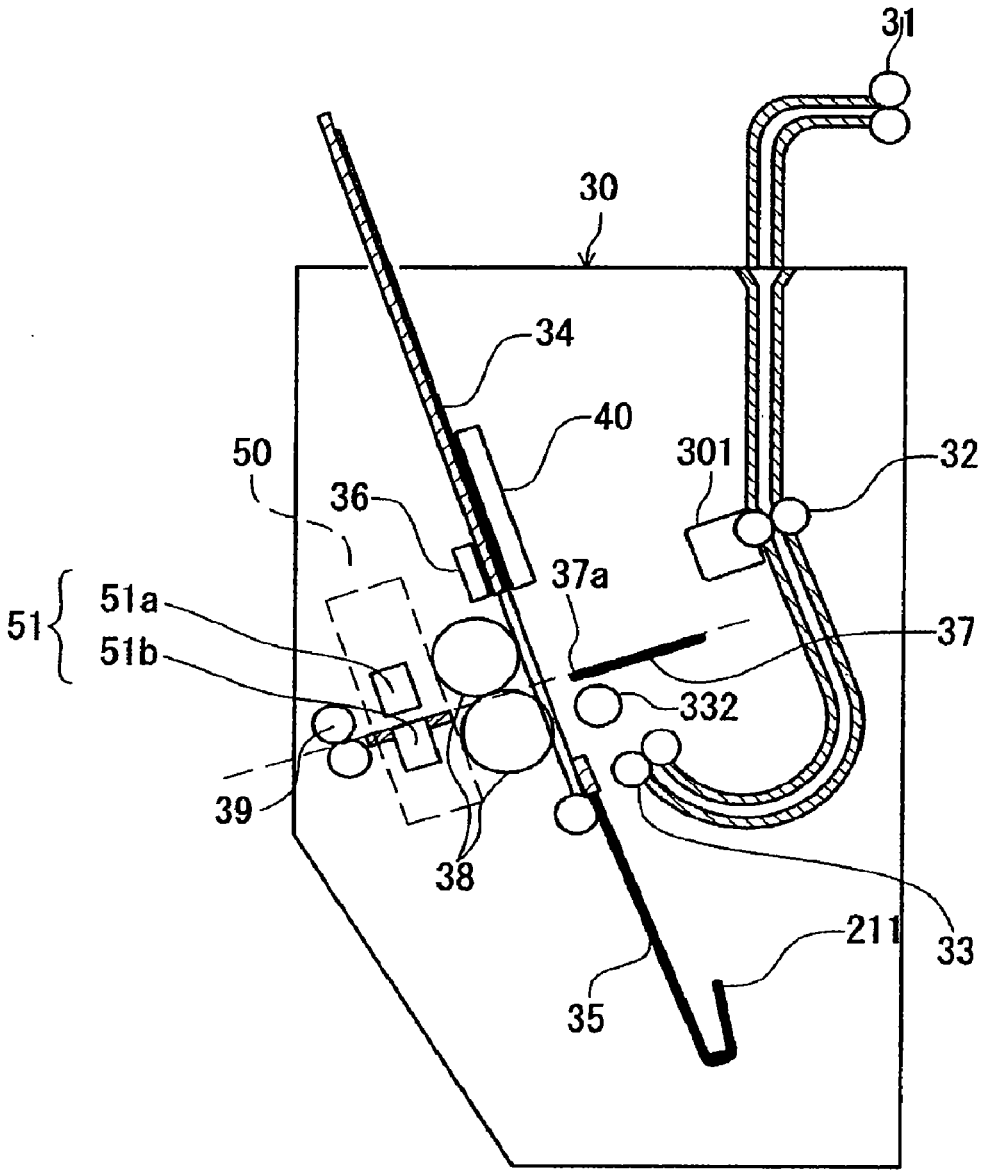
FIG. 3 is a sectional view illustrating a configuration of a sheet folding apparatus.
Figure 4:
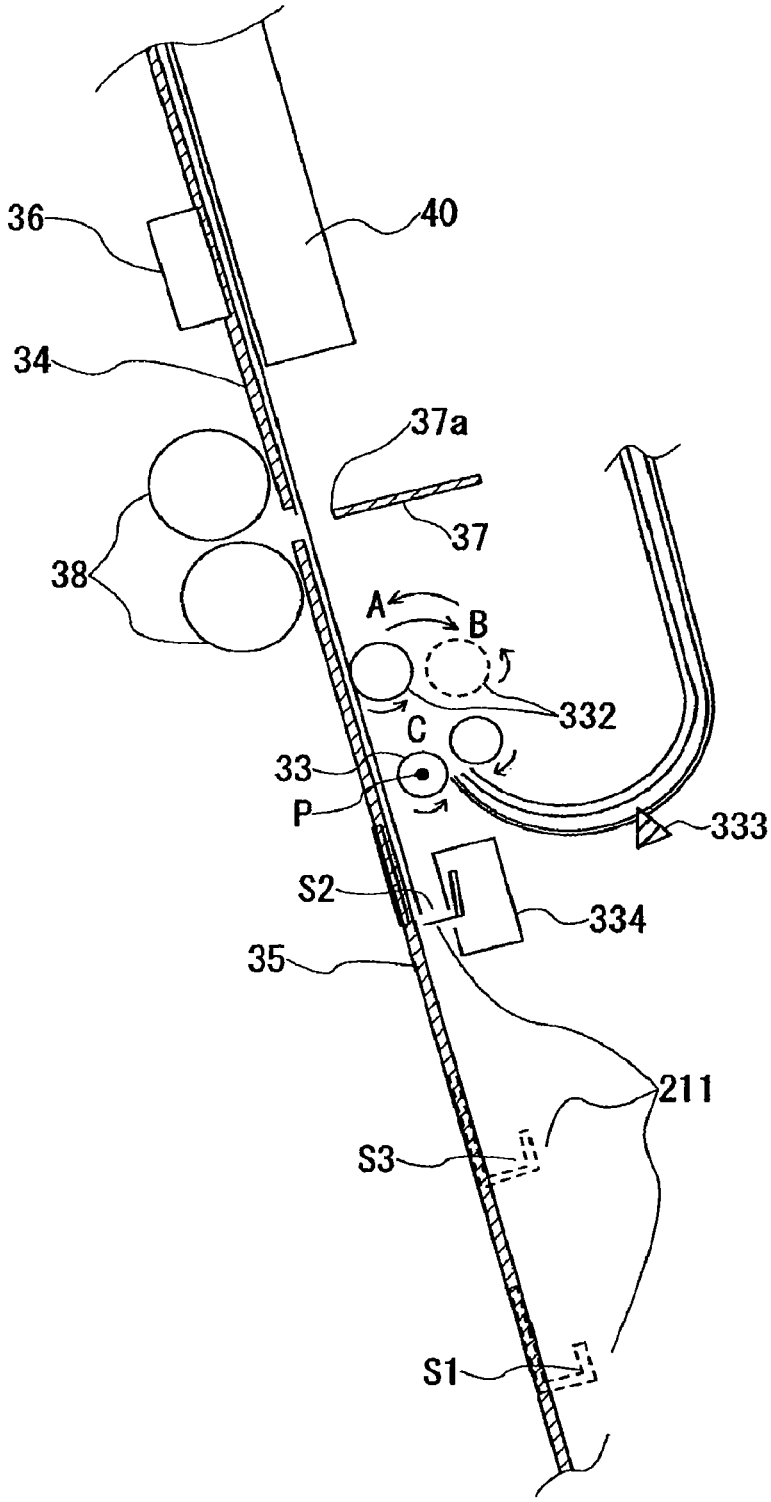
FIG. 4 is an enlarged sectional view illustrating a part of the sheet folding apparatus.

FIG. 3 is a sectional view showing a detailed configuration of the sheet folding apparatus 30. FIG. 4 is an enlarged sectional view illustrating a part of the sheet folding apparatus 30.

In the sheet folding apparatus 30, the sheet discharged from the discharge section 7C of the image forming section 12 is received by an inlet roller pair 31 and is delivered to an intermediate roller pair 32. The intermediate roller pair 32 further delivers the sheet to an outlet roller pair 33. The outlet roller pair 33 sends the sheet to a stack tray 34 having an inclined loading surface. The leading edge of the sheet moves to an upper part of the slope of the stack tray 34.

As shown in FIG. 4, an assist roller 332 is disposed at an end of the outlet roller pair 33.

The sheet folding apparatus 30 includes a conveyance motor 301 (see FIG. 3). The conveyance motor 301 drives the outlet roller pair 33 and the assist roller 332 via a timing belt not shown in synchronization with each other.

When the sheet is sent to the stack tray 34, the assist roller 332 is located at a position indicated by the broken line so as not to interfere with the sending of the sheet.

A discharge sensor 333 is disposed in a conveyance path of a sheet and detects a passage of the leading edge and the trailing edge of the sheet passing through the conveyance path. When the discharge sensor 333 detects the passage of the trailing edge of the sheet, it is determined that the sheet is completely sent to the stack tray 34 in a predetermined time after that time and the position of the assist roller 332 is moved in the direction of arrow A about a supporting point P. With this movement, the assist roller 332 comes in contact with the sheet sent to the stack tray 34.

The assist roller 332 is made to rotate in the direction of arrow C by the conveyance motor 301 and allows the sheet on the stack tray 34 to move down. The surface of the assist roller 332 is covered with a sponge or the like and can allow the sheet to move down without being damaged.

A stacker 35 having a stack pawl 211 stands by below the stack tray 34 and receives the lower edge of the sheet which is pressed down from the upper part of the slope of the stack tray 34 by the assist roller 332.

When a subsequent sheet is sent to the stack tray 34, the assist roller 332 moves back in the direction of arrow B. The reciprocation of the assist roller 332 in the directions of arrow A and arrow B is carried out with a pulling force of a solenoid 334 and a restoring force of a spring coil not shown.

In this way, sheets are sequentially accumulated on the stacker 35. In this process, a longitudinal alignment of sheets is sequentially carried out with the pressing-down of the assist roller 332. When the number of sheets reaches the number instructed from the operation section 9, a lateral alignment is carried out by a lateral alignment unit 40.

A stapler (saddle-stitching unit) 36 is disposed at the middle of the stack tray 34. When the stacker 35 receives the sheets, the stacker 35 rises up from a standby position S1 shown in FIG. 4 to a sheet receiving position S2. The sheet receiving position S2 is adjusted so that the position (the center of a sheet bundle in the vertical direction) where the sheet bundle is to be stapled faces the stapler 36.

When the sheet bundle is saddle-stitched by the stapler 36, the stacker 35 moves down until the position where a fold of the sheet bundle is to be formed reaches the front of a folding blade 37 (a folding position S3 in FIG. 4).

When the position where the fold is to be formed reaches the front of the folding blade 37, a front edge 37*a* of the folding blade 37 pushes the surface which becomes the inner surface of the folded sheet bundle.

A fold roller pair 38 is disposed in front of the folding blade 37 in the traveling direction thereof. The sheet bundle pushed by the folding blade 37 is inserted into a nipping portion of the fold roller pair 38 to form a fold at the center of the sheet bundle. The folding unit is constituted by the folding blade 37 and the fold roller pair 38.

The sheet bundle on which the fold is formed by the fold roller pair 38 is conveyed to a fold reinforcing unit 50 disposed downstream thereof. The sheet bundle conveyed to the fold reinforcing unit 50 is temporarily stopped there.

The fold reinforcing unit 50 includes a fold reinforcing roller pair 51 (an upper roller (second roller) 51*a* and a lower roller (first roller) 51*b*). The fold reinforcing roller pair 51 moves in a direction (in a direction along the line of the fold) perpendicular to the conveyance direction of the sheet bundle while applying a pressure to the fold, thereby reinforcing the fold.

The sheet bundle of which the fold is reinforced by the fold reinforcing unit 50 starts again its conveyance, and is pulled by a discharge roller pair 39 to be output to the sheet bundle loading section 41. Then, the saddle-stitched sheet bundle (booklet) is loaded on the sheet bundle loading section 41.

Figure 5:
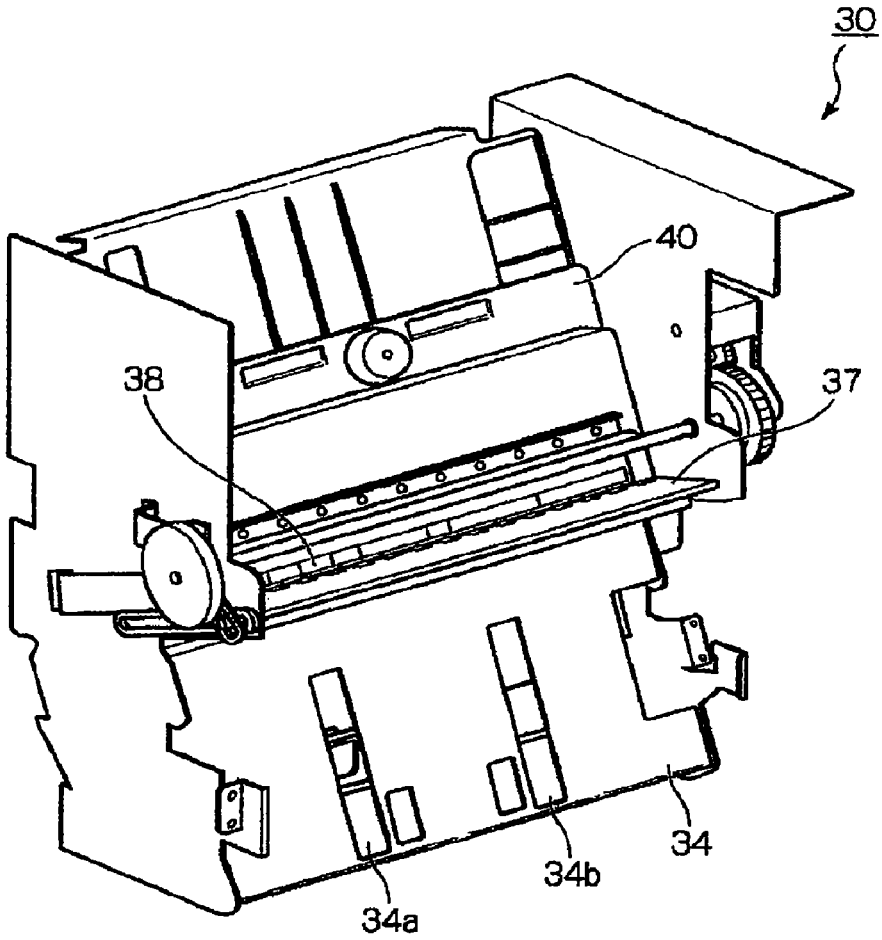
FIG. 5 is a perspective view illustrating an appearance of the sheet folding apparatus.

FIG. 5 is a perspective view of the sheet folding apparatus 30 as viewed from the front side in the sheet conveying direction. The tilted stack tray 34 is disposed below the sheet folding apparatus 30 and the lateral alignment unit 40 is disposed above the sheet folding apparatus 30. The fold roller pair 38 is disposed inside the center portion of the sheet folding apparatus 30 and the folding blade 37 is disposed in front of the fold roller pair 38. The stack pawls 211 of the stacker 35 move up and down along openings 34*a* and 34*b* of the stack tray 34 but are not shown in FIG. 5.

(2) Lateral Alignment Unit

Figures 6A, 6B:
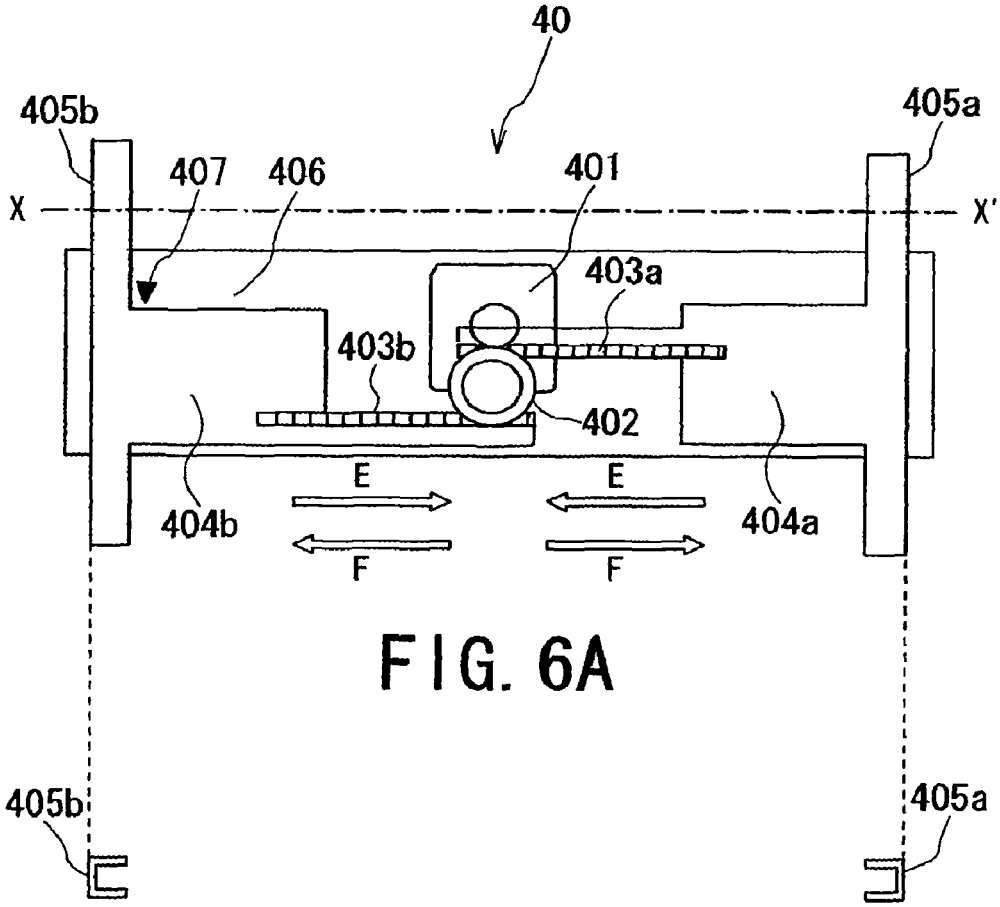
FIGS. 6A and 6B are a front view and a plan view illustrating a configuration of a lateral alignment unit, respectively.

FIG. 6A is a front view illustrating a configuration of the lateral alignment unit 40 and FIG. 6B is a plan view as viewed cut plane X-X' from the upside.

The lateral alignment unit 40 includes a lateral alignment motor 401 which is a stepping motor, a gear 402, movable frames 404*a* and 404*b* to which racks 403*a* and 403*b* are fixed, respectively, lateral alignment plates 405*a* and 405*b* disposed at both ends of the movable frames, and a support frame 406 supporting these.

The lateral alignment motor 401 allows the gear 402 to rotate in clockwise and counterclockwise directions. The gear 402 engages with the racks 403*a* and 403*b* and thus the racks 403*a* and 403*b* move in the directions of arrow E and arrow F shown in FIG. 6A with the rotation of the gear 402. The lateral alignment plates 405*a* and 405*b* move in a direction intersecting to the sheet conveying direction with the movement of the racks 403*a* and 403*b*. When the gear 402 rotates in the clockwise direction in FIG. 6A, the lateral alignment plates 405*a* and 405*b* move in the direction of arrow F (opening direction). When the gear 402 rotates in the counterclockwise direction in FIG. 6A, the lateral alignment plates 405*a* and 405*b* move in the direction of arrow E (closing direction).

The support frame 406 is provided with a lateral alignment motor HP (Home Position) sensor 407. The position of the lateral alignment plates 405*a* and 405*b* is controlled on the basis of the detection timing of the lateral alignment motor HP sensor 407 and the number of pulses of the lateral alignment motor 401.

Figure 7A:
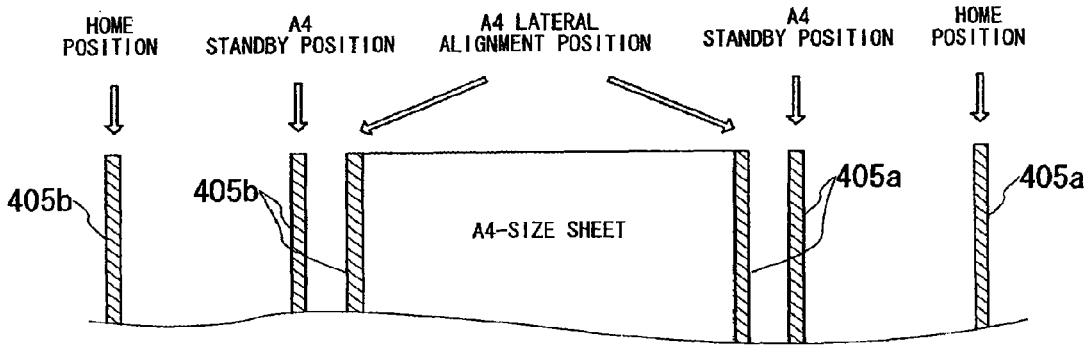
FIGS. 7A and 7B are diagrams illustrating a control position of a lateral alignment plate.
Figure 7B:
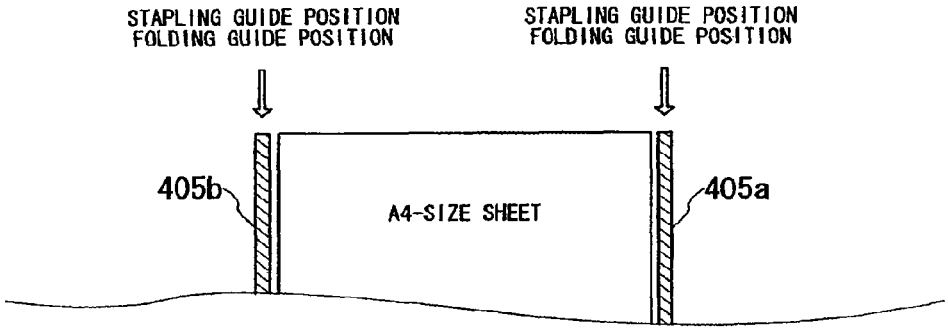

FIGS. 7A and 7B are diagrams illustrating the control position of the lateral alignment plates 405*a* and 405*b*. The home position shown in FIG. 7A is a position detected by the lateral alignment motor HP sensor 407 and the detected position serves as a base of various positions. The standby position is a position which is apart by about 15 mm from both lateral edges of the sheets, though it depends on the size of the sheets. An A4 size is assumed in FIGS. 7A and 7B. When the sheet bundle is actually subjected to the lateral alignment, the lateral alignment plates 405*a* and 405*b* move from the standby position to a position coming contact with both edges of the sheets.

When the saddle-stitching is performed by the stapler 36 or the folding is performed by pushing the folding blade 37 after the lateral alignment is performed, both edges of the sheet bundle are slightly misaligned. When the saddle-stitching or the folding is performed, the lateral alignment plates 405*a* and 405*b* are made to move to a position (a stapling guide position and a folding guide position) which has a margin by about 1 mm from both edges of the sheet bundle, as shown in FIG. 7B, to absorb the misalignment.

(3) Stacker

Figure 8:
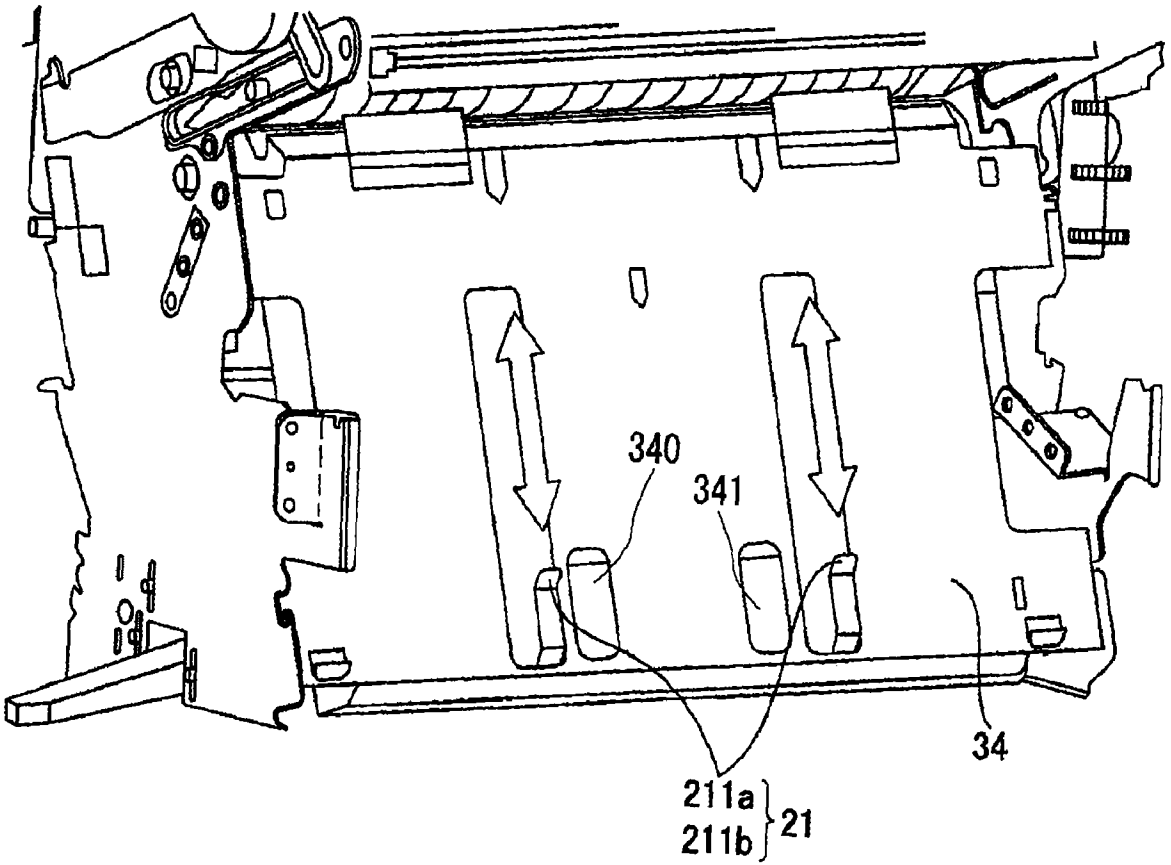
FIG. 8 is a perspective view illustrating a positional relation of a stack tray and a stack pawl.
Figure 9:
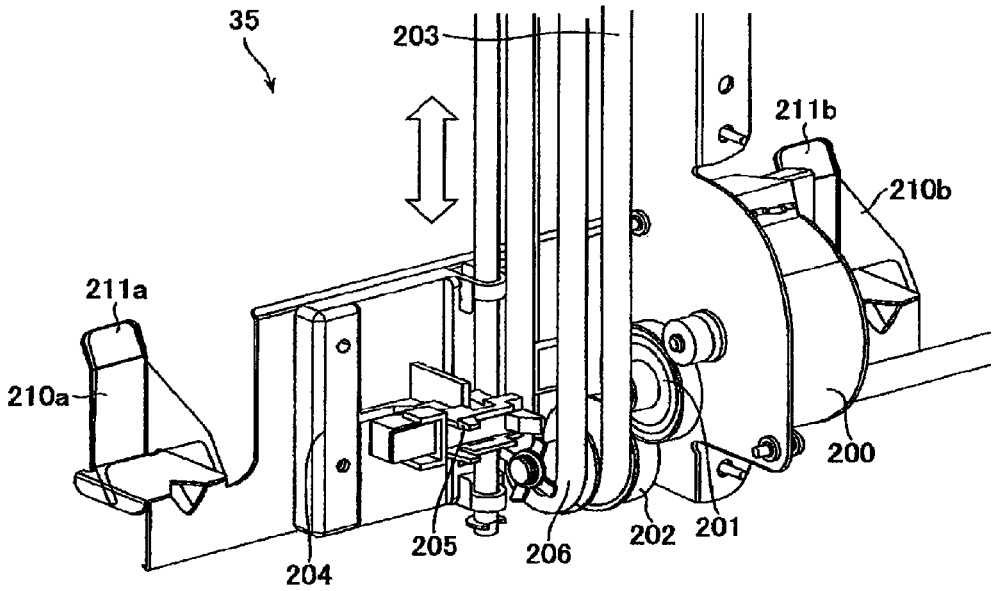
FIG. 9 is a perspective view illustrating a configuration of a stacker.

FIGS. 8 and 9 are diagrams illustrating a configuration of the stacker 35. As shown in FIG. 8, two stack pawls 211 (211*a* and 211*b*) are exposed from the lower side of the stack tray 34. The lower end of the sheet moving down along the stack tray 34 is received by the stack pawls 211 and the sheet bundle including a predetermined number of sheets is supported by the stack pawls 211.

When the saddle-stitching or the folding is performed, the stack pawls 211 are controlled to move along the slope of the stack tray 34 to a predetermined position.

As shown in FIG. 9, the stacker 35 includes a stacker motor 200 which is a stepping motor, a gear 201, a gear or pulley 202, a driving mechanism including a timing belt 203, the stack pawls 211*a* and 211*b*, and a support section 204 supporting these.

The stacker motor 200 allows the gear 201 and the gear and pulley 202 to rotate. The timing belt 203 is suspended on the gear or pulley 202 and the support section 204 fixed to the timing belt 203 is made to move in the arrow direction shown in FIG. 9.

A coil spring 206 serving to prevent the backlash is also suspended on the gear and pulley 202.

The support section 204 includes the stack pawls 211*a* and 211*b*, which moves in the arrow direction shown in FIG. 8 with the movement of the support section 204. The stack pawls 211*a* and 211*b* include flexible members 210*a* and 210*b* such as mylar, respectively, which press and hold the sheet bundle aligned in the stack pawls 211*a* and 211*b* against a reference plane of the stack tray 34.

A stacker motor HP sensor 205 is disposed to control the moving positions of the stack pawls 211*a* and 211*b*. The positions of the stack pawls 211*a* and 211*b* are controlled on the basis of the detection timing of the stacker motor HP sensor 205 and the number of pulses of the stacker motor 200.

When the sheet bundle is folded, it is necessary to accurately match the centerline of the sheet bundle with the line of the folding blade 37. The vertical position control of the sheet bundle is carried out by controlling the positions of the stack pawls 211*a* and 211*b* on the basis of the number of pulses of the stacker motor 200 as described above.

However, if the line connecting two stack pawls 211*a* and 211*b* is not parallel to the line of the folding blade 37, both sides of the sheet bundle are not aligned when the sheet bundle is folded, and thus appearance of the booklet is deteriorated.

Therefore, it is very important to the folding to adjust the line connecting two stack pawls 211*a* and 211*b* and the line of the folding blade 37 to be accurately parallel to each other. Hereinafter, this adjustment is referred to as parallelism adjustment of the stack pawls.

By providing the sheet folding apparatus 30 according to this embodiment with a simple stack-pawl adjustment mechanism adjusting the parallelism of the stack pawls and using a simple adjustment jig 290 to adjust the parallelism of the stack pawls, it is possible to easily and accurately adjust the parallelism of the stack pawls.

Figure 10:
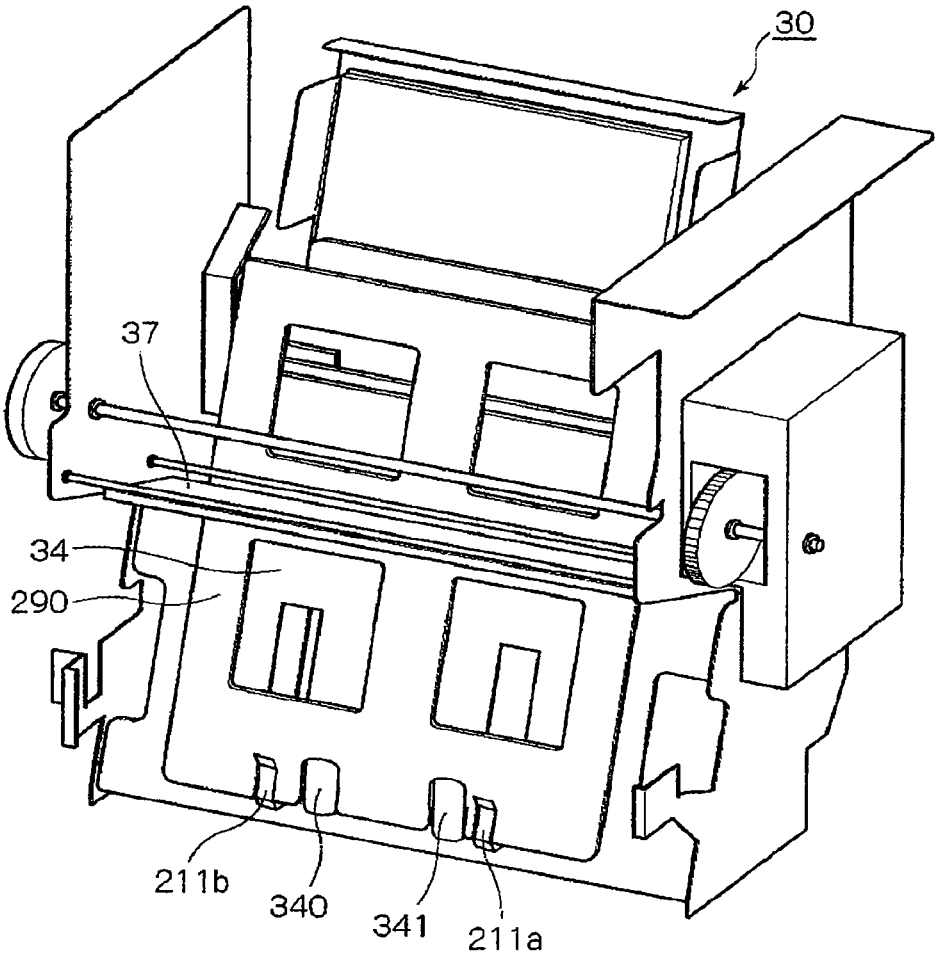
FIG. 10 is a diagram illustrating an adjustment jig loaded to the sheet folding apparatus at the time of making a parallelism adjustment of the stack pawl.

FIG. 10 is a perspective view illustrating an example where the parallelism of the stack pawls is adjusted using the adjustment jig 290.

As shown in FIG. 10, the adjustment jig 290 is, for example, a transparent plastic plate with the A4 size and imitates the size, shape, and weight of a standard sheet bundle.

Figure 11:
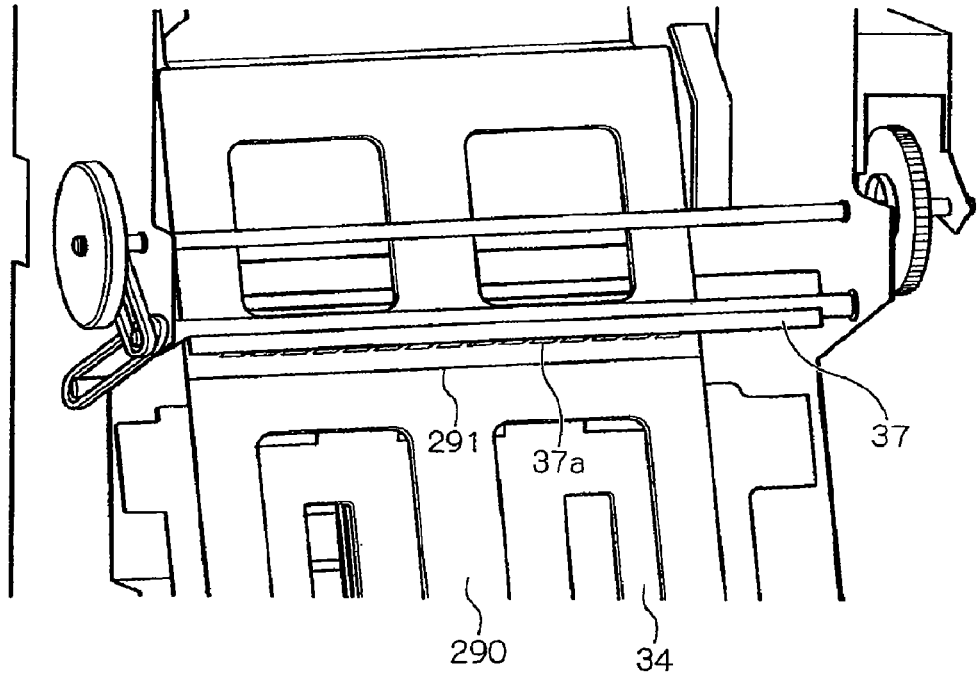
FIG. 11 is a first diagram illustrating a positional relation between the adjustment jig and a front edge of a folding blade.

As shown in FIG. 11, a positioning reference line 291 used to adjust the parallelism of the stack pawls is drawn with an easily visible color such as red at the center of the adjustment jig 290 with the A4 size. Four openings formed in the adjustment jig 290 are not essential, but allows a user to simply grasp the adjustment jig 290.

Figure 12A:
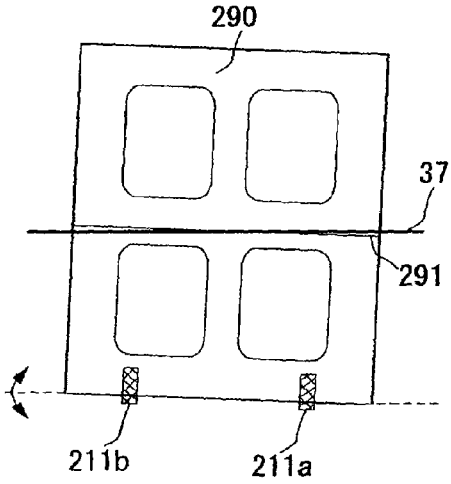
FIGS. 12A and 12B are first conceptual diagrams illustrating the parallelism adjustment of the stack pawl using the adjustment jig.
Figure 12B:
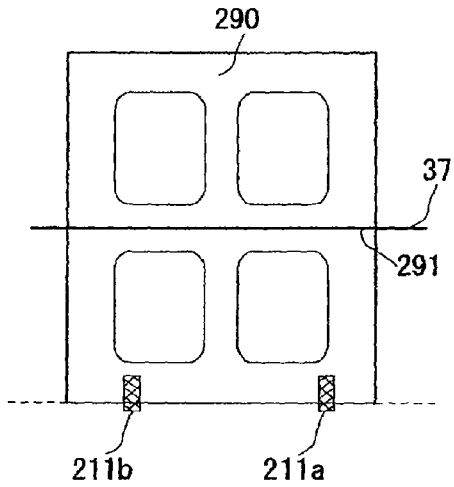

On adjusting the parallelism of the stack pawls, similarly to a usual sheet bundle, the adjustment jig 290 is supported by the stack pawls 211*a* and 211*b*. As shown in FIGS. 12A and 12B, by allowing the line connecting the stack pawl 211*a* and the stack pawl 211*b* to rotate about the line of the front edge 37*a* of the folding blade 37 for adjustment, the reference line 291 of the adjustment jig 290 is matched with the line of the front edge 37*a* of the folding blade 37. The matching thereof is checked with eyes.

Figure 13:
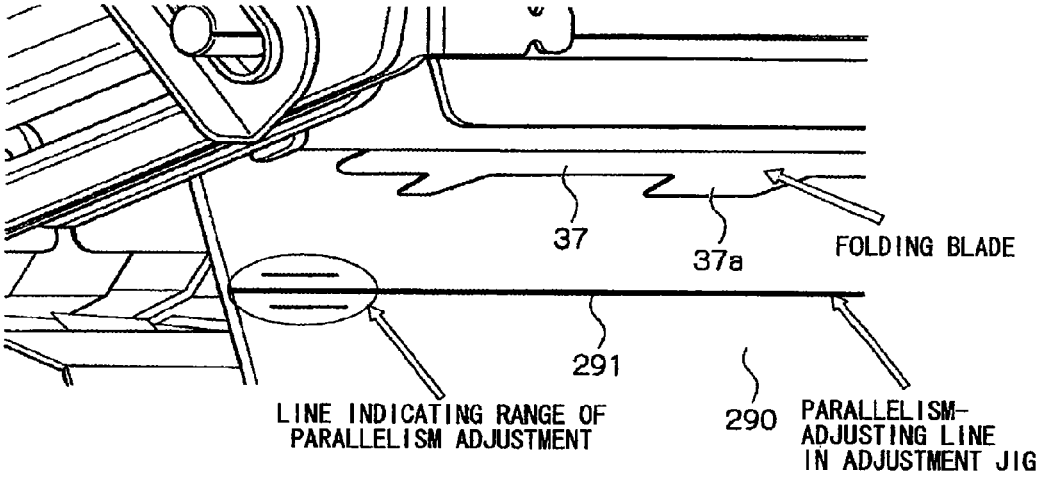
FIG. 13 is a second diagram illustrating the positional relation between the adjustment jig and the front edge of the folding blade.

As shown in FIG. 13, two allowable lines indicating an allowable range of the parallelism adjustment may be disposed at both ends of the reference line 291 of the adjustment jig 290, respectively. When it goes into the allowable range, the parallelism adjustment of the stack pawls is ended. As a result, it is possible to avoid a delay of the adjustment due to an excessive adjustment of the parallelism.

Figure 14A:
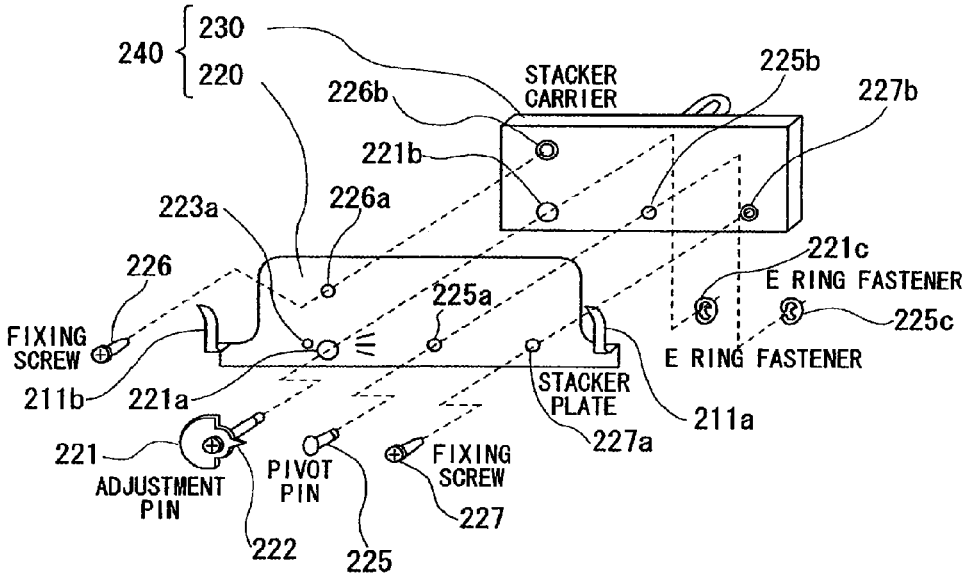
FIGS. 14A to 14C are diagrams illustrating a configuration of a stack-pawl parallelism adjustment mechanism.
Figure 14B:
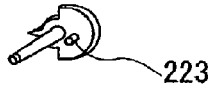
Figure 14C:
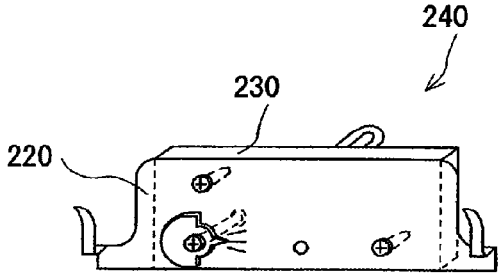
Figure 15A:
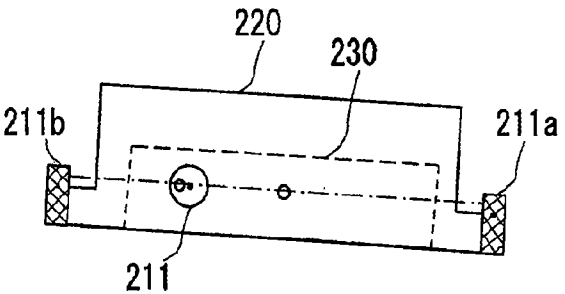
FIGS. 15A to 15D are second conceptual diagrams illustrating the parallelism adjustment of the stack pawl using the adjustment jig.
Figure 15B:
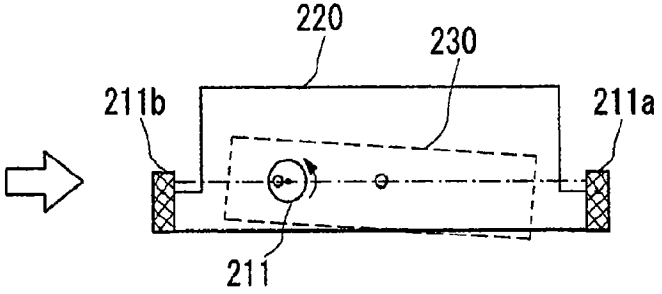
Figure 15C:
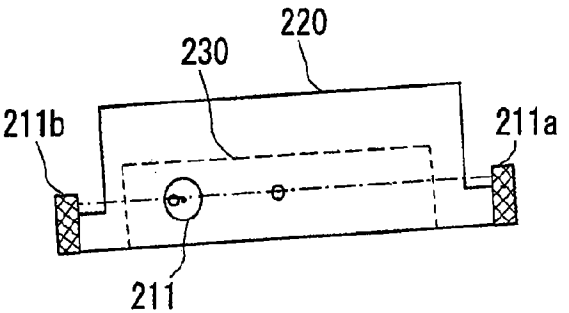
Figure 15D:
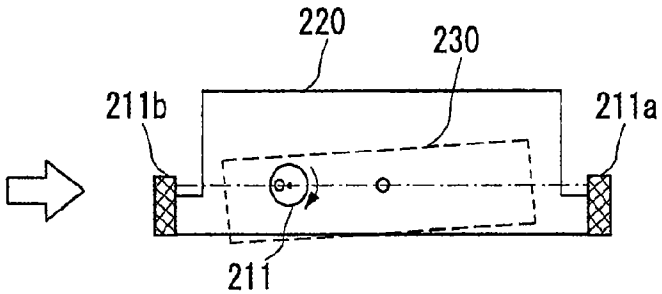

FIGS. 14A to 14C are exploded perspective view illustrating a configuration of a stack-pawl adjustment mechanism 240 adjusting the parallelism of the stack pawls.

As shown in FIGS. 14A and 14C, the stack-pawl adjustment mechanism 240 includes a stacker plate 220 and a stacker carrier 230. The stack pawls 211*a* and 211*b* are fixed to both sides of the stacker plate 220.

An adjustment pin 221 and a pivot pin 225 penetrate the stacker plate 220 and the stacker carrier 230 and are rotatably fixed with E-ring fasteners in the back of the stacker carrier 230. Pin holes 221*a* and 221*b* through which the adjustment pin 221 passes are so-called loose holes having a diameter greater than the pin diameter.

On the other hand, pin holes 225*a* and 225*b* through which the pivot pin 225 passes are tight holes without margin.

As shown in FIG. 14B, a cam pin 223 protrudes from the rear side of a semicircular plate-like member of the adjustment pin 221 and the cam pin 223 is inserted into a cam hole 223*a* of the stacker plate 220. When the adjustment pin 221 is made to rotate with a screw-driver, the position of the cam pin 223 rotates about the adjustment pin 221, and the stacker plate 220 into which the cam pin 223 is inserted rotates about the position of the pivot pin 225 with the rotation. Since the cam pin 223 is locked to only the stacker plate 220 but is not locked to the stacker carrier 230, the stacker plate 220 can be made to rotate about the pivot pin 225 relatively to the stacker carrier 230 by allowing the adjustment pin 221 to rotate. That is, the line connecting the stack pawl 211*a* and the stack pawl 211*b* can be made to rotate relative to the stacker carrier 230.

On the other hand, the parallel or non-parallel relation between the line in the longitudinal direction of the stacker carrier 230 and the line of the front edge 37*a* of the folding blade 37 is fixed. Accordingly, the line connecting the stack pawl 211*a* and the stack pawl 211*b* can be made to rotate relative to the line of the front edge 37*a* of the folding blade 37 by allowing the adjustment pin 221 to rotate.

An adjustment operator matches the line of the front edge 37*a* of the folding blade 37 with the reference line 291 of the adjustment jig 290 while rotating the adjustment pin 221. Thereafter, the adjustment operator screws fixing screws 226 and 227 into screw holes 226*b* and 227*b* of the stacker carrier 230 to fix the stacker plate 220 and the stacker carrier 230 to each other.

Screw penetrating holes 226*a* and 227*a* of the stacker plate 220 have a diameter greater than the diameter of the screws 226 and 227 so as to absorb a relative change in position between the stacker plate 220 and the stacker carrier 230.

Openings 340 and 341 are formed in the stack tray 34 (see FIGS. 8 and 10) and thus the adjustment pin 221 or the fixing screws 226 and 227 can be easily accessed from the outside.

FIGS. 15A to 15D are diagrams schematically illustrating an example where the adjustment pin 221 is made to rotate to adjust the parallelism of the line connecting the stack pawl 211*a* and the stack pawl 211*b*.

As described above, in the sheet folding apparatus 30 according to this embodiment, it is possible to easily and accurately adjust the parallelism of the stack pawls by using the adjustment jig 290 and the stack-pawl adjustment mechanism 240 together.

(4) Folding Unit

Figure 16:
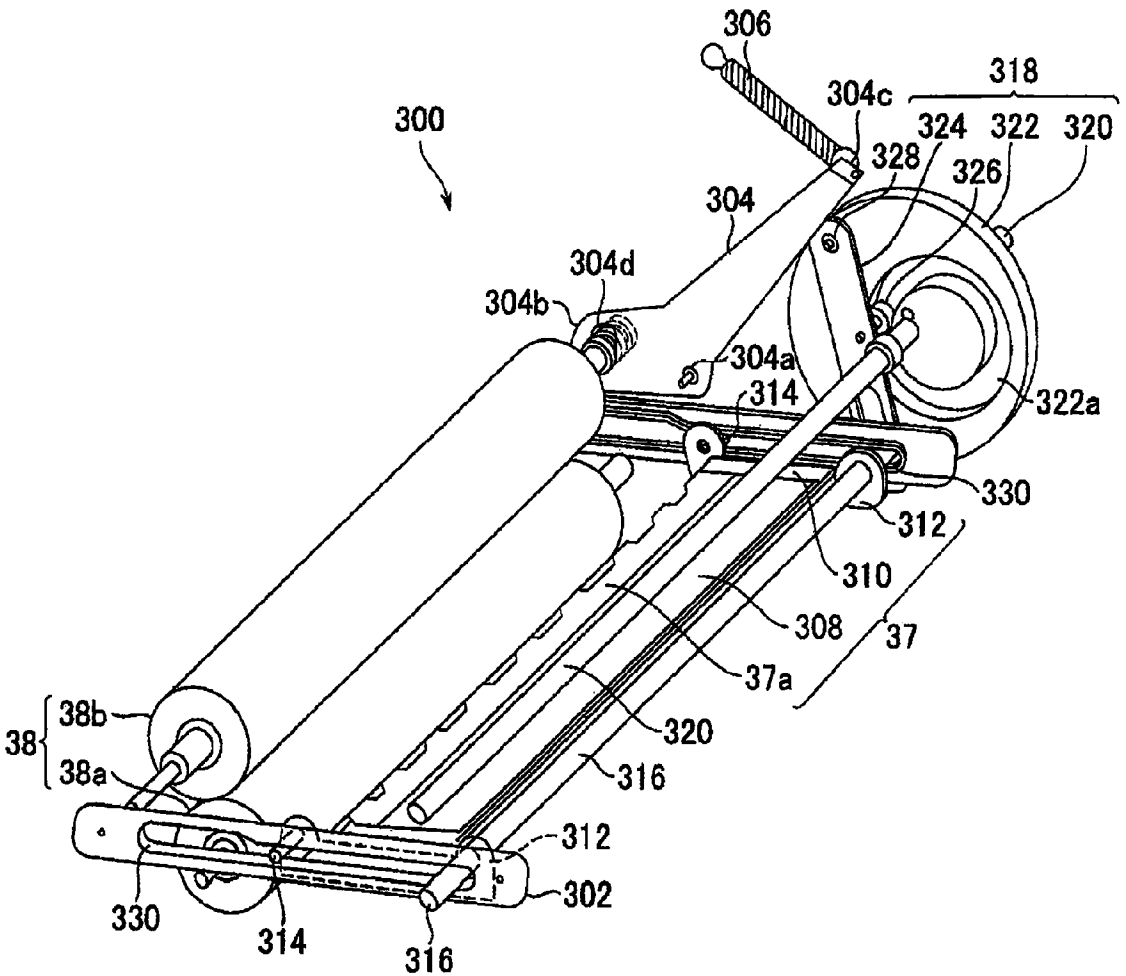
FIG. 16 is a perspective view illustrating a configuration of a folding unit.

FIG. 16 is a diagram illustrating a configuration of a folding unit 300.

The folding unit 300 includes the fold roller pair 38 folding a sheet bundle into two parts, the folding blade 37 which is a pressing member pushing the sheet bundle into the nipping portion of the fold roller pair 38, and a guide member 302 holding the folding blade 37 so as to be movable toward the fold roller pair 38 and regulating the fluctuation of the pressing member in the direction intersecting the moving direction before pushing the sheet bundle into the nipping portion.

The fold roller pair 38 includes a fixed fold roller 38*a* and a movable fold roller 38*b*. The fixed fold roller 38*a* is rotatably supported by an apparatus frame.

On the other hand, the movable fold roller 38*b* is rotatably supported by one end 304*b* of an arm 304, is movable in the direction perpendicular to the moving direction of the folding blade 37, and can be contacted with and separated from the fixed fold roller 38*a*.

A spring 306 is mounted on other end 304*c* of the arm 304. The movable fold roller 38*b* is urged by the spring 306 via the arm 304 rotating about a supporting point 304*a* and comes in press contact with the fixed fold roller 38*a* to form the nipping portion. One end 304*b* is provided with a first support hole 304*d* allowing the movable fold roller 38*b* to move straightly without drawing an arc when the arm 304 rotates.

The folding blade 37 includes the front edge 37*a* pushing a sheet bundle, first and second holding members 308 and 310 holding the front edge 37*a* interposed therebetween, and a side plate 312 attached to both ends of the second holding member 310.

A stud 314 is disposed in the front side of the side plate 312, that is, the side facing the fold roller pair 38, and a shaft 316 is disposed in the rear side thereof. The folding blade 37 is slidably held by the guide member 302 via the stud 314 and the shaft 316.

Movement of the folding blade 37 becomes more stable as the gap between the stud 314 and the shaft 316 elongates. Accordingly, in this embodiment, the position of the stud 314 is closer to the fold roller pair 38 than to the end of the front edge 37*a*. The stud 314 and the shaft 316 as the sliding member are not limited to the above-mentioned configuration, but both may be a stud or a shaft. Alternatively, they may be rotatable rollers. The fixing position of the stud 314 to the side plate 312 is not limited to the above-mentioned configuration.

Both ends of the shaft 316 are provided with a driving mechanism 318 allowing the folding blade 37 to slide. The driving mechanism 318 includes a cam shaft 320, a groove cam 322 having a groove 322*a* and rotating about the cam shaft 320, and a driven member 324. A roller 326 such as a roller follower as a contactor is rotatably guided in the groove 322*a* of the groove cam 322 and the roller 326 is attached to the driven member 324. One end of the driven member 324 is provided with a driven member rotation shaft 328 and the driven member rotation shaft 328 is attached to the apparatus frame. The groove cam 322 is made to rotate by a driving motor connected to one end of the cam shaft 320. When the roller 326 is guided along the groove 322*a* with the rotation of the groove cam 322, the driven member 324 repeats the reciprocation like a pendulum about the driven member rotation shaft 328 due to the eccentricity of the groove 322*a*.

The sheet folding apparatus 30 according to this embodiment includes a protection member (to be described later) preventing a user from carelessly touching the front edge of the folding blade 37, which is not shown in FIG. 16.

A driving mechanism of the fold roller pair 38 and the folding blade 37 will be described now.

Figure 17:
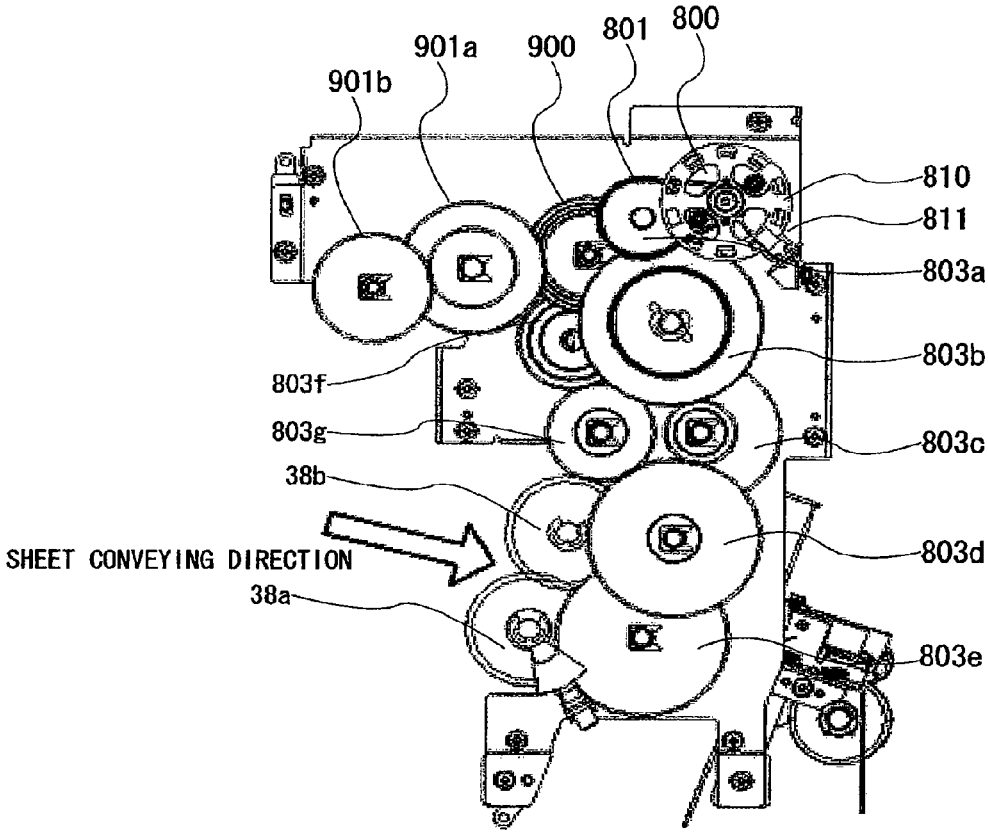
FIG. 17 is a first diagram illustrating a configuration of a folding unit driving mechanism.
Figure 18:
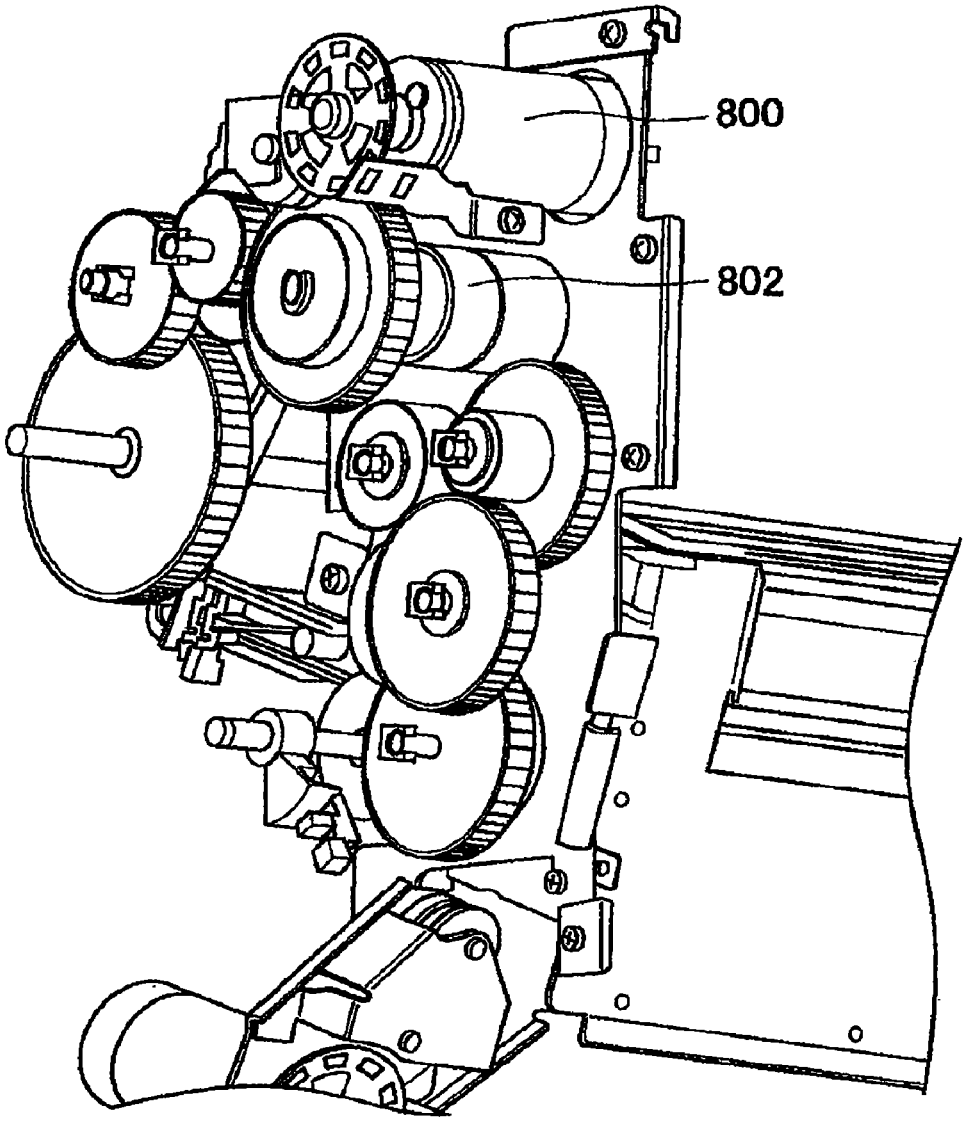
FIG. 18 is a second diagram illustrating the configuration of the folding unit driving mechanism.

FIG. 17 is a diagram illustrating a configuration of the driving mechanism of the fold roller pair 38 and the folding blade 37. The driving mechanism includes a folding motor 800 which is a DC motor (see FIG. 18), a timing belt 801, a one-way clutch 802, gears 803*a*, 803*b*, 803*c*, 803*d*, 803*e*, 803*f*, 803*g*, 901*a*, and 901*b*, and an electromagnetic clutch 900.

The folding motor 800 allows the gear 803*a* to rotate via the timing belt 801 and thus allows the electromagnetic clutch 900 and the gear 803*b* to rotate. The gear 803*b* is provided with the one-way clutch 802 (see FIG. 18). The one-way clutch 802 allows the fold roller 38*a* to rotate in a path passing through the gears 803*b*, 803*c*, 803*d*, and 803*e* when the folding motor 800 is made to rotate forwardly. On the other hand, the one-way clutch allows the fold roller 38*a* to rotate in another path, that is, a path passing through the gears 803*b*, 803*f*, 803*g*, 803*d*, and 803*e* when the folding motor 800 is made to rotate backwardly. This configuration is the driving mechanism of the fold roller pair 38.

The folding blade 37 also employs the folding motor 800 as a driving source. When the electromagnetic clutch 900 is turned on, the rotation of the folding motor 800 is transmitted to the gears 901*a* and 901*b*. The rotation of the gear 901*b* is transmitted to the driving mechanism 318 shown in FIG. 16 and thus the folding blade 37 is made to slide forward and backward about the nipping portion of the fold roller pair 38 with the rotation of the driving mechanism 318.

The folding motor 800 is provided with an encoder actuator 810 and a folding motor encoder sensor 811. The number of rotations of the fold roller pair 38 and the moving position of the folding blade 37 are controlled on the basis of an encoder pulse output from the folding motor encoder sensor 811.

Figure 19:
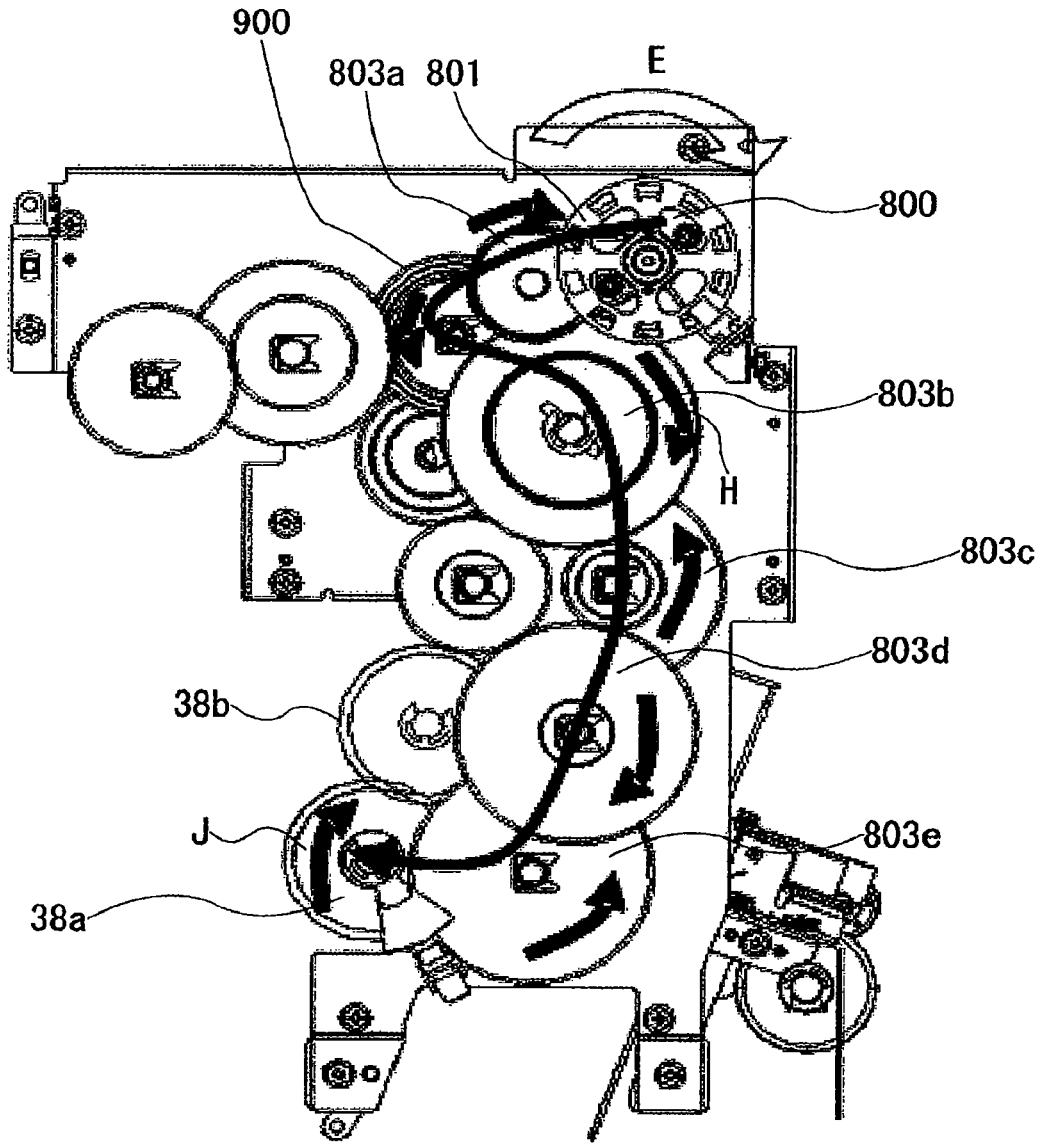
FIG. 19 is a first diagram illustrating a driving force transmitting path of the folding unit.
Figure 20:
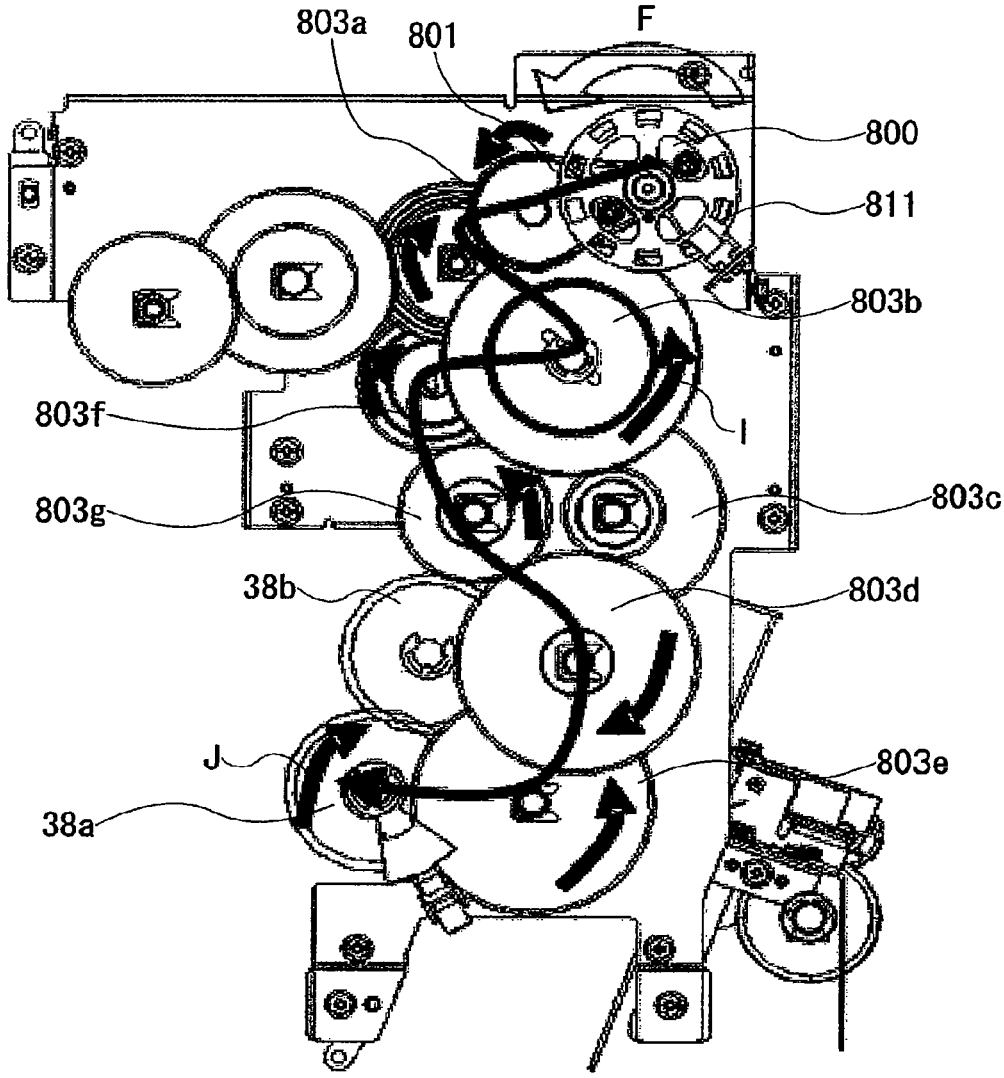
FIG. 20 is a second diagram illustrating the driving force transmitting path of the folding unit.

FIGS. 19 and 20 are diagrams illustrating a change of a rotation transmitting path due to the switching of the one-way clutch 802.

When the folding motor 800 is made to rotate in the direction of arrow E in FIG. 19, the gear 803*b* is made to rotate in the direction of arrow H via the timing belt 801, the gear 803*a*, and the electromagnetic clutch 900. When the gear 803*b* rotates in the direction of arrow H, the one-way clutch 802 transmits the rotation to the gear 803*c* and the fold roller 38*a* is thus made to rotate in the direction of arrow J via the gears 803*d* and 803*e*. The gear train employing the gear 803*c* by allowing the folding motor 800 to rotate in the direction of arrow E is configured to increase its reduction ratio. As a result, the fold roller 38*a* rotates at a low speed and with high torque.

On the other hand, as shown in FIG. 20, when the folding motor 800 is made to rotate in the direction of arrow F (the direction opposite to the direction of arrow E in FIG. 19) in FIG. 20, the gear 803*b* is made to rotate in the direction of arrow I via the timing belt 801, the gear 803*a*, and the electromagnetic clutch 900. When the gear 803*b* rotates in the direction of arrow I, the one-way clutch 802 transmits the rotation to the gear 803*f* instead of the gear 803*c* and the fold roller 38*a* is thus made to rotate in the direction of arrow J via the gears 803*g*, 803*d*, and 803*e*.

The gear train employing the gears 803*f* and 803*g* by allowing the folding motor 800 to rotate in the direction of arrow F is configured to decrease its reduction ratio. As a result, the fold roller pair 38 rotates at a high speed.

Since the gear train including the gears 803*f* and 803*g* rotates in the direction of arrow J similarly to FIG. 19, the conveyance direction of the sheet bundle in the fold roller pair 38 is not inverted.

Since the above-mentioned mechanism is provided, it is possible to drive the fold roller pair at a low speed and the high torque by allowing the folding motor 800 to rotate in the direction of arrow E in which the reduction ratio is high when the folding of the sheet bundle is controlled. On the other hand, it is possible to convey the sheet bundle to the fold reinforcing unit 50 at a high speed by temporarily stopping the rotation of the motor and then allowing the folding motor 800 to rotate in the direction of arrow F which is the opposite direction after the folding of the sheet bundle is ended.

(5) Protection Member

A paper jam may occur in the nipping portion of the fold roller pair or in the vicinity thereof due to some reasons in the course of performing the folding function. When the paper jam occurs, as described above, the movement of the fold roller pair 38 and the folding blade 37 is automatically stopped and the folding blade 37 returns to the standby position (home position). Thereafter, a user removes the jammed sheet bundle.

Depending on the position of the paper jam, the user may insert his or her hand between the fold roller pair 38 and the folding blade 37 to remove the jammed sheet.

To form an excellent fold, the folding blade 37 is formed of a hard and thin plate-like member. For example, the folding blade 37 is formed of a stainless material with a thickness of about 0.25 mm and thus the folding blade 37 has the very sharp front edge 37*a*.

Accordingly, when the user carelessly brings his or her hand into strong contact with the front edge 37*a* of the folding blade 37 at the time of removing the jammed sheet, the user's finger, etc. may be injured by the front edge 37*a*.

The sheet folding apparatus 30 according to this embodiment includes a protection member 350 to prevent such a danger.

Figure 21:
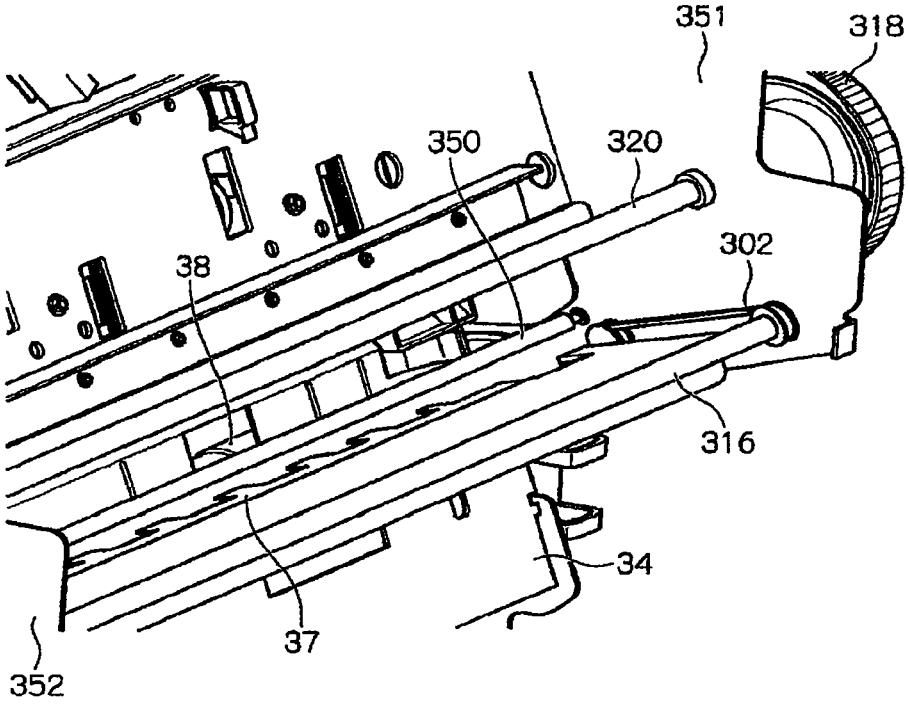
FIG. 21 is a perspective view illustrating an attachment position (above the folding blade) of a protection member (circular shaft)

FIG. 21 is a diagram illustrating an example of a position where the protection member 350 is disposed. The protection member 350 is a circular shaft formed of, for example, free-cutting steel, etc. and is disposed in the longitudinal direction of the front edge 37*a* of the folding blade 37 to prevent the user's hand or finger from carelessly approaching the front edge 37*a*.

Both ends of the protection member 350 may be fixed to side plates 351 and 352 of the sheet folding apparatus 30 or may be fixed to the guide members 302 disposed on both sides of the folding blade 37.

Figure 22A:
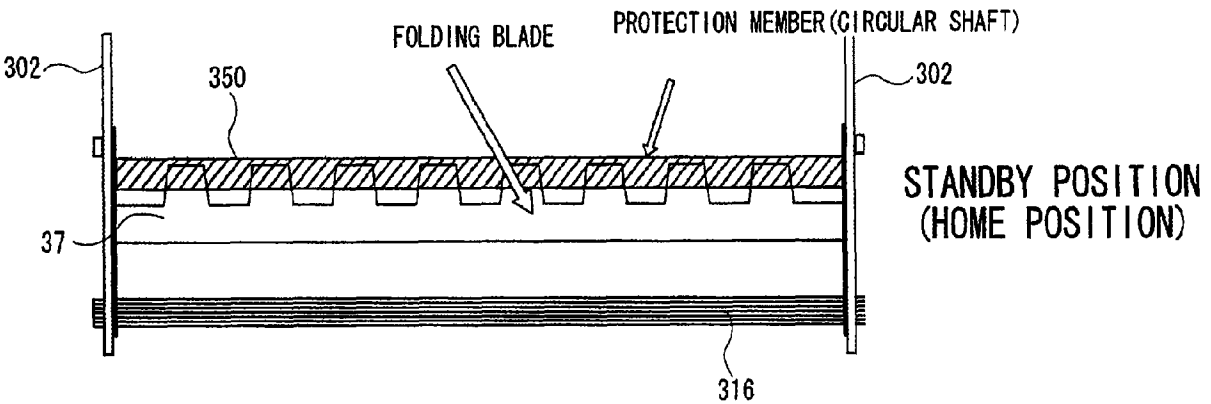
FIGS. 22A and 22B are plan views schematically illustrating a positional relation between the protection member and the folding blade.
Figure 22B:
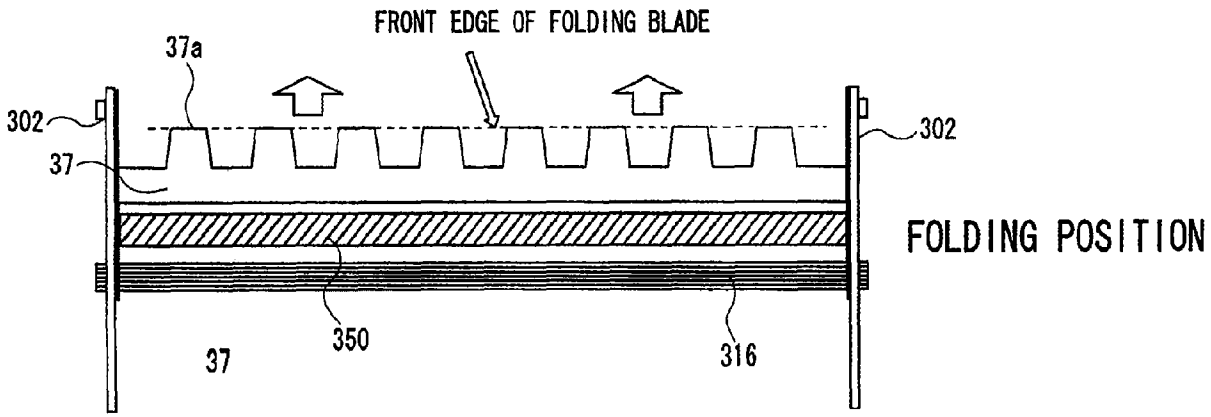
Figure 23A:
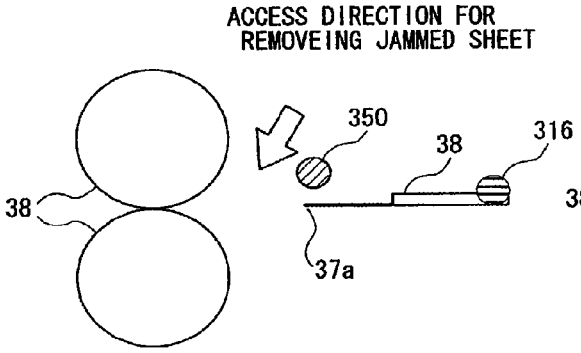
Figure 23B:
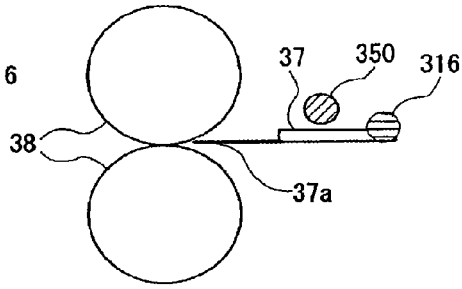

FIGS. 22A and 22B plan views as viewed from the upside. FIGS. 23A and 23B are side views. FIGS. 22A, 22B, 23A and 23B illustrate a positional relation between the protection member 350 and the folding blade 37

When the user removes the jammed sheet, the position of the folding blade 37 is returned to the standby position (home position). When the folding blade 37 is at the standby position, as shown in FIGS. 22A and 23A, the front edge 37*a* of the folding blade 37 is located at a position covered with the protection member 350. The protection member 350 has a length greater than the length in the longitudinal direction of the front edge 37*a* of the folding blade 37 and thus covers the entire front edge 37*a* of the folding blade 37.

FIGS. 22B and 23B show a state where the folding blade 37 moves to the folding position. When a lid for accessing the inside of the image forming apparatus 10 is not closed, the folding blade 37 does not move. Accordingly, in the state where the folding blade 37 is moving apart from the standby position, it is not necessary to prevent fingers, etc. from coming in contact with the front edge 37*a* of the folding blade 37.

The protection member 350 can lowers the possibility that the fingers, etc. come in contact with the front edge 37*a* of the folding blade 37, by allowing the protection member to get as close as possible to the folding blade 37 within a range not interfering with the reciprocation of the folding blade 37.

The direction in which a hand can access the paper jam position to remove the jammed sheet varies depending on the type of the sheet folding apparatus 30 (or the image forming apparatus 10).

A type in which the paper jam position can be accessed only from the upper side of the folding blade 37 (the upside in FIGS. 23A and 23B), a type in which the paper jam position can be accessed only from the lower side of the folding blade 37 (the downside in FIGS. 23A and 23B), and a type in which the paper jam position can be accessed from both the upper side and the lower side of the folding blade 37 may exist.

In the type in which the paper jam position can be accessed only from the upper side of the folding blade 37, the protection member 350 can be disposed above the folding blade 37 as shown in FIG. 21, FIGS. 22A and 22B, and FIGS. 23A and 23B.

Figure 24A:
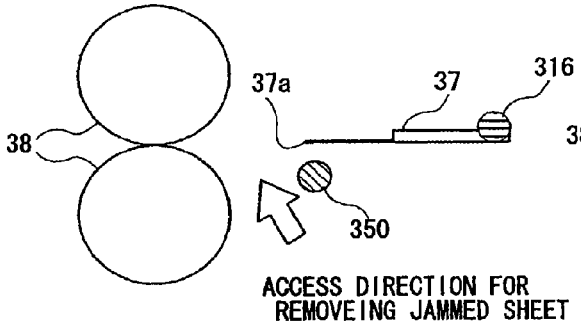
FIG. 24A is a diagram illustrating a configuration in which the protection member is disposed below the folding blade.
Figure 25:
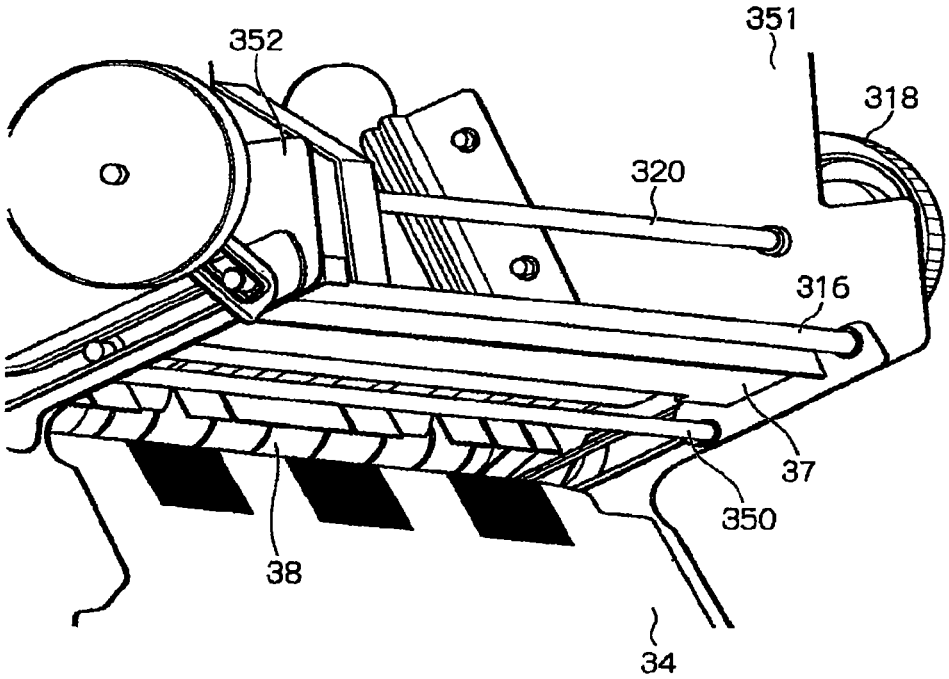
FIG. 25 is a diagram illustrating a configuration in which the protection member is disposed below the folding blade.

On the other hand, in the type in which the paper jam position can be accessed only from the lower side of the folding blade 37, the protection member 350 can be disposed below the folding blade 37 as shown in FIGS. 24A and 25.

Figure 24B:
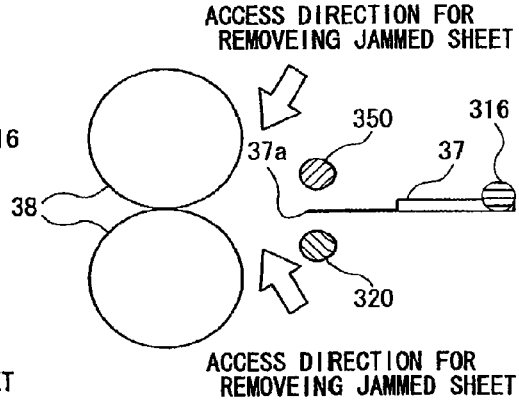
FIG. 24B is a diagram illustrating a configuration in which the protection member is disposed both above and below the folding blade.

In the type in which the paper jam position can be accessed from both the upper side and the lower side of the folding blade 37, as shown in FIG. 24B, the protection member 350 can be disposed both above and below the folding blade 37.

Figure 26C:
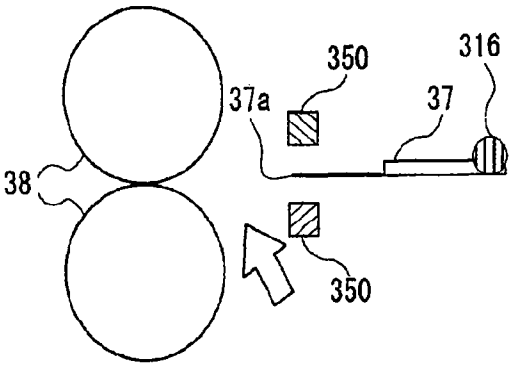
FIGS. 26A to 26C are diagrams illustrating a configuration in which a protection member of a rectangular shaft is disposed.
Figure 26B:
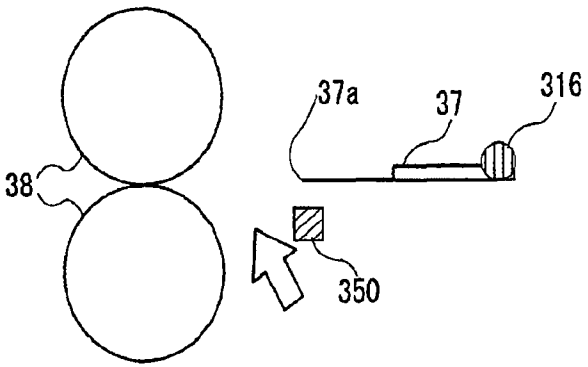
Figure 26A:
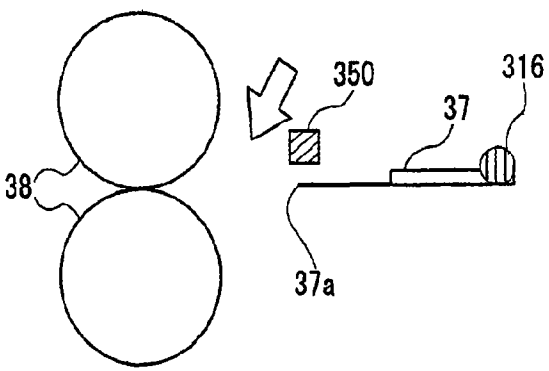

The sectional shape of the protection member 350 is not particularly limited, but a rectangular shaft may be used instead of the circular shaft as shown in FIGS. 26A to 26C. FIG. 26A shows an example where the protection member 350 of the rectangular shaft is disposed above the folding blade 37, FIG. 26B shows an example where the protection member is disposed below the folding blade 37, and FIG. 26C shows an example where the protection member is disposed both above and below the folding blade 37.

As described above, in the sheet folding apparatus 30 and the image forming apparatus 10 according to this embodiment, it is possible to safely remove a sheet bundle even when a paper jam occurs.

The invention is not directly limited to the respective embodiments, and can be embodied by modifying the components within the range not departing from the gist. Besides, the invention of various embodiments can be formed by suitable combinations of plural components disclosed in the respective embodiments. For example, some components may be deleted from all components disclosed in the embodiment. Further, components of different embodiments may be suitably combined.

What is claimed is:

1. A sheet folding apparatus comprising:

a fold roller pair which forms a nipping portion and inserts the center of a sheet bundle into the nipping portion to form a fold in the sheet bundle;

a folding blade which moves from a standby position and presses the center of the sheet bundle against the nipping portion when the fold is formed, and returns to the standby position after the pressing of the nipping portion is completed; and a protection member which prevents an access to a front edge of the folding blade in a longitudinal direction of the front edge when the folding blade is located at the standby position.

2. The apparatus according to claim 1, wherein the protection member is disposed above the folding blade.

3. The apparatus according to claim 1, wherein the protection member is disposed below the folding blade.

4. The apparatus according to claim 1, wherein the protection member is disposed both above and below the folding blade.

5. The apparatus according to claim 1, wherein the protection member is a circular shaft having a length equal to or greater than the length in the longitudinal direction of the front edge of the folding blade.

6. The apparatus according to claim 2, wherein the protection member is a circular shaft having a length equal to or greater than the length in the longitudinal direction of the front edge of the folding blade.

7. The apparatus according to claim 3, wherein the protection member is a circular shaft having a length equal to or greater than the length in the longitudinal direction of the front edge of the folding blade.

8. The apparatus according to claim 4, wherein the circular shaft is formed of free-cutting steel.

9. The apparatus according to claim 1, wherein the protection member is a rectangular shaft having a length equal to or greater than the length in the longitudinal direction of the front edge of the folding blade.

10. The apparatus according to claim 9, wherein the rectangular shaft is formed of free-cutting steel.

* * * * *